US011408389B2

(12) United States Patent
Terada

(10) Patent No.: US 11,408,389 B2
(45) Date of Patent: Aug. 9, 2022

(54) IGNITION APPARATUS FOR INTERNAL COMBUSTION ENGINE

(71) Applicant: DENSO CORPORATION, Kariya (JP)

(72) Inventor: Kanechiyo Terada, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/102,924

(22) Filed: Nov. 24, 2020

(65) Prior Publication Data

US 2021/0095631 A1 Apr. 1, 2021

Related U.S. Application Data

(63) Continuation of application No. PCT/JP2019/020566, filed on May 24, 2019.

(30) Foreign Application Priority Data

May 25, 2018 (JP) ..... JP2018-100972

(51) Int. Cl.

| | |
|---|---|
| ***F02P 3/04*** | (2006.01) |
| ***F02P 3/05*** | (2006.01) |
| ***F02P 15/10*** | (2006.01) |
| ***F02P 9/00*** | (2006.01) |

(52) U.S. Cl.

CPC ..... *F02P 3/0435* (2013.01); *F02P 3/05* (2013.01); *F02P 3/051* (2013.01); *F02P 9/007* (2013.01); *F02P 15/10* (2013.01)

(58) Field of Classification Search

None

See application file for complete search history.

(56) References Cited

U.S. PATENT DOCUMENTS 3,897,767 A * 8/1975 Gordon ..... F02P 3/01 123/607
4,398,526 A * 8/1983 Hamai ..... F02P 9/007 123/620

(Continued)

FOREIGN PATENT DOCUMENTS

CN 112204246 A * 1/2021 ..... F02P 3/0435
DE 112019002673 T5 * 2/2021 ..... F02P 3/0435

(Continued)

*Primary Examiner* — Kevin R Steckbauer
(74) *Attorney, Agent, or Firm* — Nixon & Vanderhye P.C.

(57) ABSTRACT

An ignition apparatus for internal combustion engine includes an ignition coil in which a main primary coil and an auxiliary primary coil are magnetically coupled with a secondary coil that is connected to a spark plug. In the ignition apparatus, a main ignition circuit unit controls energization of the main primary coil and performs a main ignition operation in which a spark discharge is generated in the spark plug. An energy supply circuit unit controls energization of the auxiliary primary coil and performs an energy supply operation in which a current that has the same polarity as a secondary current that flows through the secondary coil as a result of the main ignition operation is superimposed on the secondary current. The auxiliary primary coil includes a plurality of auxiliary-primary-coil portions. The energy supply circuit unit performs the energy supply operation using one or more of the plurality of auxiliary-primary-coil portions.

18 Claims, 23 Drawing Sheets

(56) References Cited

U.S. PATENT DOCUMENTS

| | | | | | |
|---|---|---|---|---|---|
| 4,562,823 | A * | 1/1986 | Moritugu | F02P 7/035 | 123/622 |
| 4,664,092 | A * | 5/1987 | Kaufmann | F02P 7/035 | 123/643 |
| 4,674,467 | A * | 6/1987 | Tokura | F02P 3/01 | 123/655 |
| 4,702,221 | A * | 10/1987 | Tokura | F02P 3/0442 | 315/209 T |
| 4,763,061 | A * | 8/1988 | Schwarz | H02M 3/33538 | 320/140 |
| 4,911,126 | A * | 3/1990 | Notaras | F02P 15/10 | 123/406.56 |
| 5,806,504 | A * | 9/1998 | French | F02P 9/007 | 123/622 |
| 5,808,727 | A | 9/1998 | Katayama | | |
| 6,705,302 | B2 * | 3/2004 | Meinders | F02P 3/0435 | 123/655 |
| 10,113,526 | B2 * | 10/2018 | Takeda | F02P 15/00 | |
| 10,811,849 | B2 * | 10/2020 | Miyake | H01T 13/04 | |
| 10,883,468 | B2 * | 1/2021 | Terada | F02P 3/051 | |
| 10,965,205 | B2 * | 3/2021 | Ha | H02J 7/022 | |
| 10,989,161 | B2 * | 4/2021 | Ohno | F02P 13/00 | |
| 2002/0134363 | A1 * | 9/2002 | Meinders | F02P 3/0453 | 123/620 |
| 2009/0194083 | A1 | 8/2009 | Boerjes | | |
| 2015/0292467 | A1 * | 10/2015 | Forte | F02P 3/0407 | 123/621 |
| 2017/0022960 | A1 * | 1/2017 | Takeda | F02P 9/007 | |
| 2017/0284356 | A1 * | 10/2017 | Takeda | F02P 9/007 | |
| 2018/0358782 | A1 * | 12/2018 | Miyake | F02P 15/10 | |
| 2019/0312499 | A1 * | 10/2019 | Ha | B60L 1/003 | |
| 2020/0200138 | A1 * | 6/2020 | Terada | H01F 38/12 | |
| 2020/0200139 | A1 * | 6/2020 | Ohno | F02P 3/053 | |
| 2020/0318598 | A1 * | 10/2020 | Iwaki | F02P 3/05 | |
| 2021/0079881 | A1 * | 3/2021 | Terada | F02P 3/05 | |
| 2021/0095631 | A1 * | 4/2021 | Terada | H01F 38/12 | |
| 2021/0102521 | A1 * | 4/2021 | Terada | F02P 11/00 | |
| 2021/0203136 | A1 * | 7/2021 | Shono | F02P 3/0442 | |

FOREIGN PATENT DOCUMENTS

| | | | | |
|---|---|---|---|---|
| JP | 11210607 | A * | 8/1999 | F02P 3/0435 |
| JP | 2007120374 | A * | 5/2007 | F02P 3/0435 |
| JP | 2015-200279 | | 11/2015 | |
| JP | 2015200279 | A * | 11/2015 | F02P 15/10 |
| JP | 2015206355 | A * | 11/2015 | F02P 17/12 |
| JP | 2016-053358 | | 4/2016 | |
| JP | WO2017183062 | A1 * | 10/2017 | F02P 15/10 |
| JP | 6297899 | B2 * | 3/2018 | F02P 15/10 |
| JP | 2018084209 | A * | 5/2018 | F02P 3/0435 |
| JP | 6570737 | B2 * | 9/2019 | F02P 15/10 |
| JP | 2019203488 | A * | 11/2019 | F02P 3/0435 |
| WO | WO-2017183062 | A1 * | 10/2017 | F02P 15/10 |
| WO | WO-2019225723 | A1 * | 11/2019 | F02P 3/0435 |

* cited by examiner

IGNITION APPARATUS FOR INTERNAL COMBUSTION ENGINE

CROSS-REFERENCE TO RELATED APPLICATIONS

The present application is a continuation application of International Application No. PCT/JP2019/020566, filed May 24, 2019, which claims priority to Japanese Patent Application No. 2018-100972, filed May 25, 2018. The contents of these applications are incorporated herein by reference in their entirety.

BACKGROUND

Technical Field

The present disclosure relates to an ignition apparatus for an internal combustion engine.

Related Art

In an ignition apparatus of a spark-ignition-type vehicle engine, an ignition coil that has a primary coil and a secondary coil is connected to a spark plug that is provided for each cylinder. A high voltage that is generated in the secondary coil is applied to the spark plug when energization of the primary coil is interrupted, and a spark discharge is generated. In addition, there is an ignition apparatus that is provided with a means for supplying discharge energy after a spark discharge is started and enables the spark discharge to be continued, to improve ignitability of an air-fuel mixture by spark discharge.

SUMMARY

On aspect of the present disclosure provides an ignition apparatus for an internal combustion engine that includes an ignition coil, a main ignition circuit unit, and an energy supply circuit unit. In the ignition coil, a main primary coil and an auxiliary primary coil are magnetically coupled with a secondary coil that is connected to a spark plug. The main ignition circuit unit controls energization of the main primary coil and performs a main ignition operation in which a spark discharge is generated in the spark plug. The energy supply circuit unit controls energization of the auxiliary primary coil and performs an energy supply operation in which a current that has the same polarity as a secondary current that flows through the secondary coil as a result of the main ignition operation is superimposed on the secondary current. The auxiliary primary coil includes a plurality of auxiliary-primary-coil portions. The energy supply circuit unit performs the energy supply operation using one or more of the plurality of auxiliary-primary-coil portions.

DESCRIPTION OF THE EMBODIMENTS

Figure 1:
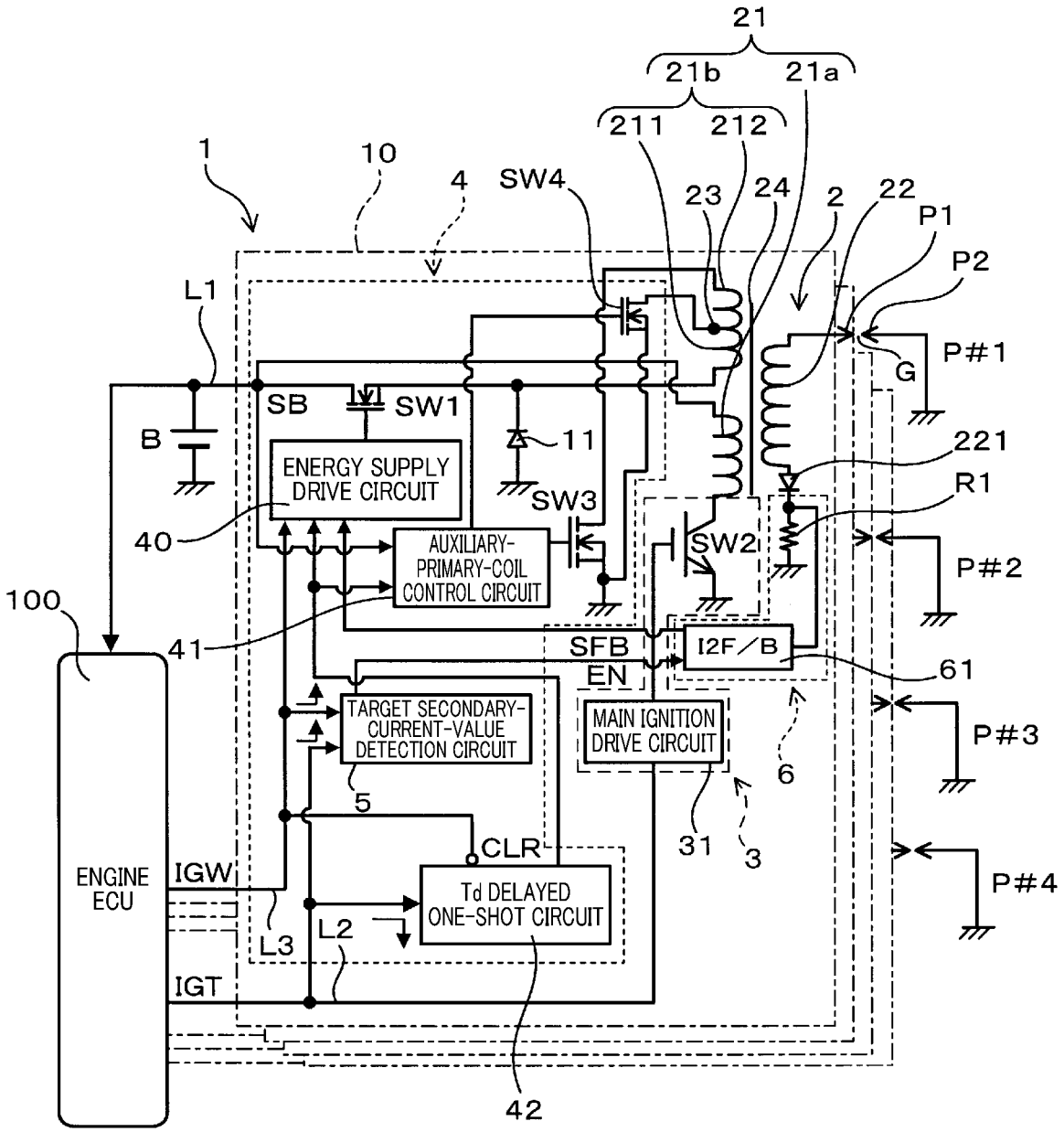
FIG. 1 is a circuit configuration diagram of an ignition control apparatus to which an ignition apparatus for an internal combustion engine according to a first embodiment is applied.

In an ignition apparatus of a spark-ignition-type vehicle engine, an ignition coil that has a primary coil and a secondary coil is connected to a spark plug that is provided for each cylinder. A high voltage that is generated in the secondary coil is applied to the spark plug when energization of the primary coil is interrupted, and a spark discharge is generated. In addition, there is an ignition apparatus that is provided with a means for supplying discharge energy after a spark discharge is started and enables the spark discharge to be continued, to improve ignitability of an air-fuel mixture by spark discharge.

At this time, a plurality of ignitions in which an ignition operation by a single ignition coil is repeated can be performed. However, to enable a more stable ignition control to be performed, there is that in which, during a spark discharge that is generated by a main ignition operation, discharge energy is added and a secondary current is increased in an superimposed manner. For example, JP-A-2016-053358 proposes an ignition apparatus in which ignitability is improved by an energy supply circuit being provided. In the energy supply circuit, after energization of the primary coil is interrupted and main ignition is started, electrical energy is supplied from a grounding side of the primary coil and the spark discharge is continued so as to remain in the same direction.

The ignition apparatus disclosed in JP-A-2016-053358 switches connection between a power supply line and a grounding line by a switch so that a power-supply-side terminal of the primary coil is grounded, during an operation period of the energy supply circuit. As a result of the switch that connects the grounding side of the primary coil and the power supply line being switched on/off in this state, a power supply voltage can be supplied and the secondary current that has the same polarity as that during the main ignition can be superimposed. In addition, an ignition apparatus that is provided with an auxiliary primary coil in parallel with the primary coil, and performs energy supply by the auxiliary primary coil being energized after energization of the primary coil by the power supply is also proposed.

As in the ignition apparatus in JP-A-2016-053358, in the energy supply circuit that performs energy supply using the power supply voltage, if a primary voltage that is generated at the primary coil is higher for some reason than the voltage that is applied to the primary coil from the power supply, energy supply may no longer be able to be performed. For example, decrease in the power supply voltage may occur at engine start, or a discharge maintenance voltage may increase in an engine operation state in which a flow rate inside a cylinder increases, thereby resulting in increase in the primary voltage. Moreover, when the secondary current that is superimposed increases, a drop voltage at the secondary coil may increase and the primary voltage that rebounds from the secondary coil to the primary coil based on a turn ratio may increase.

In such cases, for example, the turn ratio of the primary coil and the secondary coil may be increased and the primary voltage may be kept low, thereby achieving a configuration that can be used even at a low voltage. However, circuit elements tend to increase in size to accommodate increase in a primary current. In addition, because inductance in the primary coil decreases, rising of the primary current becomes faster and high-speed on/off-control is required. Furthermore, the ignition apparatus tends to increase in size and become expensive to accommodate increase in an amount of heat generation and the like. Such issues similarly arise in configurations that include the auxiliary primary coil. Countermeasures are desired.

The present disclosure has been achieved in light of the above-described issues. The present disclosure aims to provide an ignition apparatus for an internal combustion engine that is compact, has high performance, and is capable performing energy supply over a wider range by reducing a range in which execution of energy supply is restricted.

It is thus desired to provide an ignition apparatus for an internal combustion engine that is compact, has high performance, and is capable of performing a main ignition operation and an energy supply operation with high controllability, while preventing changes in apparatus configuration and complexity in a system.

An exemplary embodiment of the present disclosure provides an ignition apparatus for an internal combustion engine that includes: an ignition coil in which a main primary coil and an auxiliary primary coil are magnetically coupled with a secondary coil that is connected to a spark plug; a main ignition circuit unit that controls energization of the main primary coil and performs a main ignition operation in which a spark discharge is generated in the spark plug; and an energy supply circuit unit that controls energization of the auxiliary primary coil and performs an energy supply operation in which a current that has the same polarity as a secondary current that flows through the secondary coil as a result of the main ignition operation is superimposed on the secondary current. The auxiliary primary coil includes a plurality of auxiliary-primary-coil portions. The energy supply circuit unit performs the energy supply operation using one or more of the plurality of auxiliary-primary-coil portions.

As a result of the above-described ignition apparatus, for example, one or more of the plurality of auxiliary-primary-coil portions can be selectively used based on a state of a power supply voltage and an operation state of an engine, and the energy supply operation can be performed. Consequently, size increase of circuit elements, high-speed on/off-control, and the like are not required. Energy can be superimposed on the secondary current over a wide operation range, while increase in size and cost of the ignition apparatus is suppressed.

As described above, according to the above-described exemplary embodiment, an ignition apparatus for an internal combustion engine that is compact, has high performance, and is capable performing energy supply over a wider range by reducing a range of an operation state of the internal combustion engine in which execution of energy supply is restricted can be provided.

First Embodiment

An ignition apparatus for an internal combustion engine according to a first embodiment will be described with reference to FIG. 1 to FIG. 3.

In FIG. 1, for example, an ignition apparatus 10 is applied to a spark-ignition-type engine that is mounted in a vehicle. The ignition apparatus 10 configures an ignition control apparatus 1 that controls ignition of a spark plug P that is provided for each cylinder. The ignition control apparatus 1 includes the ignition apparatus 10 that is provided with an ignition coil 2, a main ignition circuit unit 3, and an energy supply circuit unit 4, and an engine electronic control unit (engine ECU) 100 that serves as a control apparatus for the internal combustion engine that provides the ignition apparatus 10 with an ignition command.

The ignition coil 2 is configured by a main primary coil 21*a* and an auxiliary primary coil 21*b* that serve as a primary coil 21 being magnetically coupled with a secondary coil 22 that is connected to the spark plug P. The main ignition circuit unit 3 controls energization of the main primary coil 21*a* of the ignition coil 2 and performs a main ignition operation in which a spark discharge is generated in the spark plug P. The energy supply circuit unit 4 controls energization of the auxiliary primary coil 21*b*, and performs an energy supply operation in which a current that has the same polarity as a secondary current I2 that flows to the secondary coil 22 as a result of the main ignition operation is superimposed on the secondary current I2.

The auxiliary primary coil 21*b* includes a plurality of auxiliary-primary-coil portions 211 and 212. The energy supply circuit unit 4 performs the energy supply operation using one or more of the plurality of auxiliary-primary-coil portions 211 and 212. Specifically, the plurality of auxiliary-primary-coil portions 211 and 212 are provided so as to be capable of connecting to a direct-current power supply B that is a shared power supply. The energy supply circuit unit 4 controls the energy supply operation by switching the connection between the plurality of auxiliary-primary-coil portions 211 and 212, and the direct-current power supply B.

At this time, to enable energy supply from the direct-current power supply B, the energy supply circuit unit 4 selects a portion or all of the plurality of auxiliary-primary-coil portions 211 and 212, and performs switching of the auxiliary primary coil 21*b*. As described hereafter, according to the present embodiment, whether energy supply is possible is determined based on a voltage value (referred to, hereafter, as a power supply voltage, as appropriate) of the direct-current power supply B, and a portion or all of the auxiliary-primary-coil portions 211 and 212 can be selectively connected to the direct-current power supply B.

Figure 2:
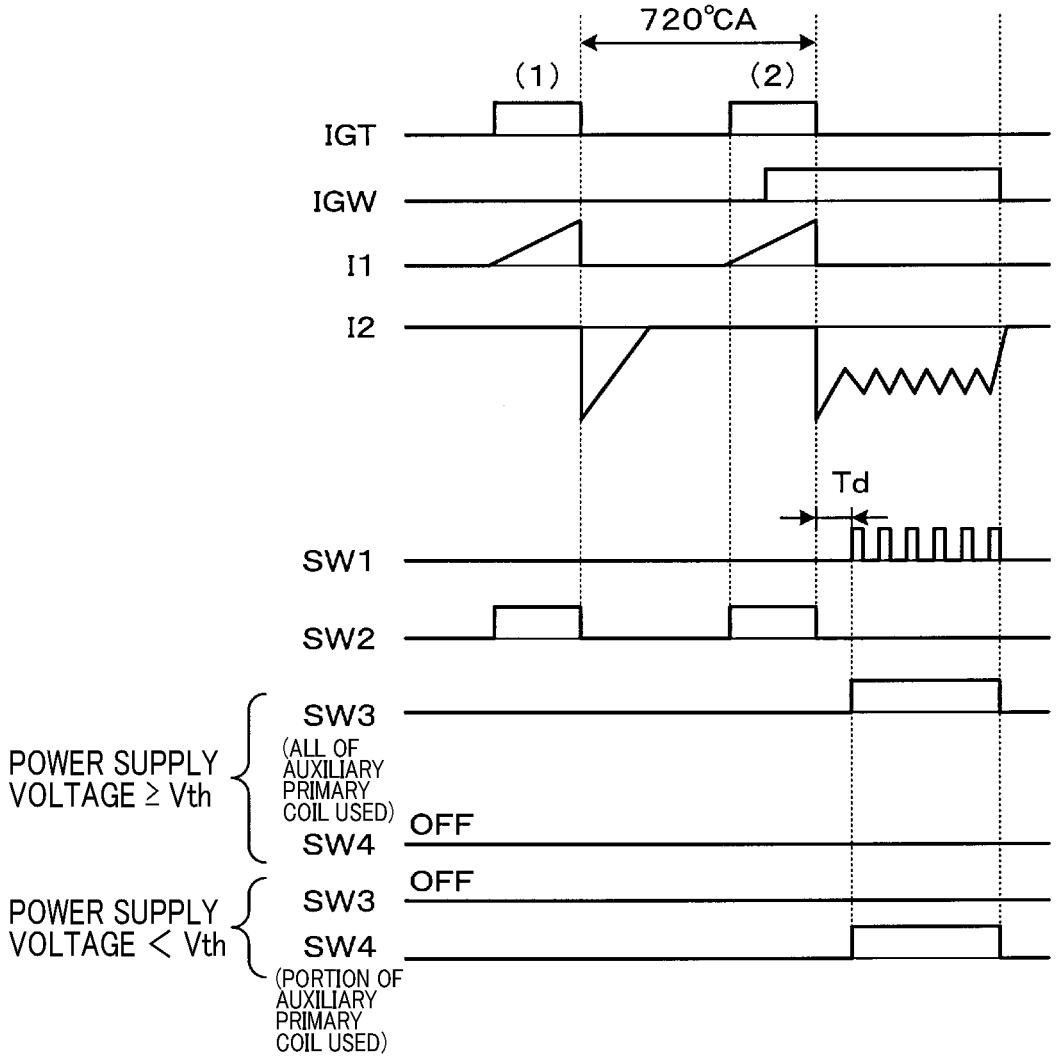
FIG. 2 is a time chart of transitions in a main ignition operation and an energy supply operation according to the first embodiment.

The engine ECU 100 generates a pulse-like main ignition signal IGT and transmits the main ignition signal IGT to the ignition apparatus 10, at each combustion cycle (for example, see FIG. 2). Furthermore, when an engine operation state is in an energy supply operation range, an energy supply signal IGW is outputted following the main ignition signal IGT. The main ignition signal IGT is inputted to the main ignition circuit unit 3. The energy supply signal IGW is inputted to the energy supply circuit unit 4.

The ignition apparatus 10 operates the main ignition circuit unit 3 based on the main ignition signal IGT and controls the main ignition operation. In addition, the ignition apparatus 10 operates the energy supply circuit unit 4 based on the energy supply signal IGW and controls the energy supply operation to the main ignition circuit unit 3.

The ignition apparatus 10 further includes a feedback control unit 6 that performs feedback control of the secondary current I2 based on a detection signal from a target secondary-current-value detection circuit 5. The target secondary-current-value detection circuit 5 is for detecting a set value of a target secondary-current value I2tgt at the energy supply operation. The target secondary-current value I2tgt is set in advance by the engine ECU 100 based on the engine operation state and the like. For example, the target secondary-current value I2tgt is given as pulse waveform information of the main ignition signal IGT and the energy supply signal IGW.

A configuration of each section of the ignition control apparatus 1 including the ignition apparatus 10 will be described in detail below.

For example, the engine to which the ignition apparatus 10 according to the present embodiment is applied is a four-cylinder engine. The spark plug P (for example, denoted as P#1 to P#4 in FIG. 1) is provided in correspondence to each cylinder. In addition, the ignition apparatus 10 is provided in correspondence to each spark plug P. The main ignition signal IGT and the energy supply signal IGW are respectively transmitted from the engine ECU 100 to each ignition apparatus 10, via output signal lines L2 and L3.

The spark plug P has a publicly known configuration that includes a center electrode P1 and a grounding electrode P2 that oppose each other. A space that is formed between tip ends of both electrodes serves as a spark gap G. Discharge energy that is generated in the ignition coil 2 based on the main ignition signal IGT is supplied to the spark plug P. A spark discharge is generated in the spark gap G, thereby enabling ignition of an air-fuel mixture inside an engine combustion chamber (not shown) to be performed. At this time, to improve ignitability, the energy supply circuit unit 4 is operates based on the engine operation state and supplies energy to continue the spark discharge.

In the ignition coil 2, the main primary coil 21*a* or the auxiliary primary coil 21*b*, and the secondary coil 22 are magnetically coupled with each other, thereby configuring a publicly known step-up transformer. One end of the secondary coil 22 is connected to the center electrode P1 of the spark plug P, and another end is grounded via a first diode 221 and a secondary-current detection resistor R1.

The first diode 221 is arranged such that an anode terminal is connected to the secondary coil 22 and a cathode terminal is connected to the secondary-current detection resistor R1. The first diode 221 controls a direction of the secondary current I2 that flows through the secondary coil 22. The secondary-current detection resistor R1 configures the feedback control unit 6, together with a secondary-current feedback circuit (for example, denoted as I2F/B in FIG. 1) 61 that is described in detail hereafter.

The main primary coil 21*a* and the auxiliary primary coil 21*b* that serve as the primary coil 21 are connected in parallel to the direct-current power supply B, such as a vehicle battery.

In the main primary coil 21*a*, one end that serves as a power-supply-side terminal is connected to a power supply line L1 that leads to the direct-current power supply B, and another end that serves as a grounding-side terminal is grounded via a switching element (referred to for short, hereafter, as a main ignition switch) SW2 for main ignition. As a result, when the main ignition switch SW2 is on-driven, energization can be performed from the direct-current power supply B to the main primary coil 21*a*.

The auxiliary primary coil 21*b* is composed of the two auxiliary-primary-coil portions 211 and 212 that are connected in series. Switching can be performed so that either of the auxiliary-primary-coil portions 211 and 212 or both are energized from the direct-current power supply B.

In the auxiliary primary coil 21*b*, one end on the auxiliary-primary-coil portion 211 side that serves as a power-supply-side terminal is connected to the power supply line L1 via a switching element (referred to for short, hereafter, as a discharge continuation switch) SW1 for discharge continuation. In addition, another end on the auxiliary-primary-coil portion 212 side that serves as a grounding-side terminal is grounded via a switching element (referred to for short, hereafter, as an energization permission switch) SW3 for energization permission.

The discharge continuation switch SW1 is arranged between a connection point between the power supply line L1 and the main primary coil 21*a*, and the auxiliary-primary-coil portion 211. The discharge continuation switch SW1 opens and closes the power supply line L1 that serves as an energization path. As a result, when the discharge continuation switch SW1 and the energization permission switch SW3 are on-driven, energization can be performed from the direct-current power supply B to all of the auxiliary primary coil 21*b*.

According to the present embodiment, the two auxiliary-primary-coil portions 211 and 212 are connected in series with an intermediate tap 23 therebetween. The intermediate tap 23 is grounded via a switching element (referred to for short, hereafter, as a changeover switch) SW4 for switching of the auxiliary-primary-coil portions 211 and 212. In the auxiliary-primary-coil portion 211, one end is connected to the discharge continuation switch SW1 and another end is connected to the intermediate tap 23. In the auxiliary-primary-coil portion 212, one end is connected to the intermediate tap 23 and another end is connected to the energization permission switch SW3.

As a result, when the discharge continuation switch SW1 and the changeover switch SW4 are on-driven, energization can be performed from the direct-current power supply B to the auxiliary-primary-coil portion 211 that is a portion of the auxiliary primary coil 21*b*.

A second diode 11 is provided between the discharge continuation switch SW1 and the auxiliary primary coil 21*b*. In the second diode 11, an anode terminal is grounded and a cathode terminal is connected to the power-supply-side terminal of the auxiliary primary coil 21*b*. As a result, when the discharge continuation switch SW1 is off, even when energization of the auxiliary primary coil 21*b* is stopped, a return current flows in the second diode 11, and the current in the auxiliary primary coil 21*b* gradually changes. Therefore, sudden decrease in the secondary current I2 can be suppressed.

In the ignition coil 2, for example, the primary coil 21 and the secondary coil 22 are magnetically coupled and integrally configured as a result of the primary coil 21 and the secondary coil 22 being wound around a primary coil bobbin and a secondary coil bobbin that are arranged around a core 24.

At this time, as a result of a turn ratio that is a ratio of a number of turns of the main primary coil 21*a* or the auxiliary primary coil 21*b* that are the primary coil 21 and a number of turns of the secondary coil 22 being made sufficiently large, a predetermined high voltage that is based on the turn ratio can be generated in the secondary coil 22. The main primary coil 21*a* and the auxiliary primary coil 21*b* are wound such that directions of a magnetic flux that is generated during energization from the direct-current power supply B are opposite directions. The number of turns of the auxiliary primary coil 21*b* is set to be less than the number of turns of the main primary coil 21*a*.

As a result, after a discharge is generated in the spark gap G of the spark plug P by the voltage that is generated by energization of the main primary coil 21*a* being interrupted, a superimposing magnetic flux in the same direction can be generated by energization of the auxiliary primary coil 21*b*. A current that has the same polarity as the discharge current by the main primary coil 21*a* can be added to the discharge current in a superimposed manner. Discharge energy can be increased while the polarity of the discharge current is maintained.

The main ignition circuit unit 3 is configured to include the main ignition switch SW2 and a switch drive circuit (referred to for short, hereafter, as a main ignition drive circuit) 31 for the main ignition operation that on/off-drives the main ignition switch SW2. The main ignition switch SW2 is a voltage-driven-type switching element, such as an insulated-gate bipolar transistor (IGBT).

As a result of a gate potential being controlled based on a drive signal that is inputted to a gate terminal, a collector terminal and an emitter terminal are conductive or blocked therebetween. The collector terminal of the main ignition switch SW2 is connected to the other end of the main primary coil 21*a*. The emitter terminal is grounded.

The output signal line L2 is connected to the main ignition drive circuit 31. The main ignition signal IGT from the engine ECU 10 is inputted to the main ignition drive circuit 31. The main ignition drive circuit 31 generates a drive signal in correspondence to the main ignition signal IGT, and on-drives or off-drives the main ignition switch SW2.

Specifically (for example, see FIG. 2), when the main ignition switch SW2 is turned on at a rising of the main ignition signal IGT, energization of the main primary coil 21*a* starts. A primary current I1 that flows through the main primary coil 21*a* gradually increases.

Next, when the main ignition switch SW2 is turned off at a falling of the main ignition signal IGT, energization of the main primary coil 21*a* is interrupted. A high voltage is generated in the secondary coil 22 by mutual induction. This high voltage is applied to the spark gap G of the spark plug P. A spark discharge is generated and the secondary current I2 flows.

The energy supply circuit unit 4 includes the discharge continuation switch SW1 and a switch drive circuit (referred to, hereafter, as an energy supply drive circuit) 40 for the energy supply operation that on/off-drives the discharge continuation switch SW1. The energy supply drive circuit 40 sets the discharge continuation switch SW1 to an on-state when the energy supply operation is performed. In addition, the energy supply drive circuit 40 includes the energization permission switch SW3 that permits energization of all of the auxiliary primary coil 21*b*, the changeover switch SW4 that switches to energization of a portion of the auxiliary primary coil 21*b*, and an auxiliary-primary-coil control circuit 41. The auxiliary-primary-coil control circuit 41 on/off-drives the energization permission switch SW3 and the changeover switch SW4, and controls energization of the auxiliary primary coil 21*b*.

The discharge continuation switch SW1, the energization permission switch SW3, and the changeover switch SW4 are voltage-driven-type switching elements such as metal-oxide-semiconductor field-effect transistors (MOSFETs). As a result of a gate potential being controlled based on a drive signal that is inputted to a gate terminal, a drain terminal and a source terminal are conductive or blocked therebetween.

The drain terminal of the discharge continuation switch SW1 is connected to the direct-current power supply B, and the source terminal is connected to one end of the auxiliary primary coil 21*b* on the auxiliary-primary-coil portion 211 side. The drain terminal of the energization permission switch SW3 is connected to one end of the auxiliary primary coil 21*b* on the auxiliary-primary-coil portion 212 side. The drain terminal of the changeover switch SW4 is connected to the intermediate tap 23. The source terminals of the energization permission switch SW3 and the changeover switch SW4 are grounded.

The energy supply circuit unit 4 further includes a one-shot pulse generation circuit (referred to, hereafter, as a Td delayed one-shot circuit) 42 that sets a predetermined delay time Td from the main ignition operation for start of the energy supply operation. The main ignition signal IGT from the engine ECU 100 is inputted to an input terminal of the Td delayed one-shot circuit 42 via the output signal line L2.

A one-shot pulse (single-pulse) signal that is delayed by a predetermined amount of time from the falling of the main ignition signal IGT is outputted to the energy supply drive circuit 40. In addition, the energy supply signal IGW from the engine ECU 100 is inputted to the energy supply drive circuit 40 via the output signal line L3. The energy supply drive circuit 40 includes an AND circuit to which the energy supply signal IGW, the Td delayed one-shot pulse signal, and an output signal of the secondary-current feedback circuit 61 are inputted. The energy supply drive circuit 40 controls the energy supply operation as described hereafter.

The Td delayed one-shot circuit 42 provides a function for setting an energy supply start timing from the main ignition operation. The Td delayed one-shot circuit 42 also functions as an energy-supply permitted-period setting unit. The Td delayed one-shot circuit 42 sets the permitted period of the energy supply operation in the ignition apparatus 10 and outputs a pulse signal that serves as a permission signal for the energy supply operation.

For example, the permission signal is a pulse signal that is generated based on the output signal from the engine ECU 100 with the main ignition signal IGT as a trigger. A maximum period of the permitted period is set based on a pulse width of the pulse signal. In addition, after outputting the pulse signal based on the main ignition signal IGT and designating the start of the energy supply period, the Td delayed one-shot circuit 42 can designate the end of the energy supply period based on the energy supply signal IGW.

Specifically, when the falling of the main ignition signal IGT is detected, the Td delayed one-shot circuit 42 generates a one-shot pulse signal that has the predetermined delay Td and a pulse width that is longer than that of the energy supply signal IGW. The Td delayed one-shot circuit 42 outputs the one-shot pulse signal to the auxiliary-primary-coil control circuit 41. In addition, the energy supply signal IGW from the engine ECU 100 is inputted to a clear terminal CLR of the Td delayed one-shot circuit 42 via the output signal line L3. For example, reset is performed by an L-level signal of the energy supply signal IGW.

Here, the delay time Td is provided to enable the energy supply operation to be performed at a predetermined timing at which discharge is likely to have been started in the spark gap G after the main ignition operation of the spark plug P, when the energy supply signal IGW that indicates an execution period of the energy supply operation is outputted.

For example, the delay time Td is set as appropriate so that the energy supply operation is performed after the secondary current I2 that flows as a result of the main ignition operation has decreased to a certain extent. As a result, unnecessary energization of the auxiliary primary coil 21*b* that occurs as a result of the auxiliary primary coil 21*b* being energized before the discharge is generated or when the secondary current I2 has not decreased to a target value can be prevented.

In addition, a width (duration) of the one-shot pulse signal from the Td delayed one-shot circuit 42 is set to a maximum period over which energy supply is permitted based on a heat generation limit of the ignition apparatus 10 and the like. As a result, even in cases in which the energy supply signal IGW is fixed at H level or becomes unexpectedly excessive, the energy supply operation can be stopped inside the ignition apparatus 10 regardless of the energy supply signal IGW. The apparatus can be protected.

In addition, when the width of the energy supply signal IGW is within expectations, the Td delayed one-shot circuit 42 can be cleared by the L-level output of the energy supply signal IGW. The output pulse can be reset to L level, and preparation for a next operation can be made.

The energy supply drive circuit 40 determines whether the energy supply operation is required based on the delayed one-shot pulse signal from the Td delayed one-shot circuit 2 and the energy supply signal IGW, and on-drives or off-drives the discharge continuation switch SW1 at a predetermined timing.

Specifically (for example, see FIG. 2), a drive signal of the discharge continuation switch SW1 is generated with input of the energy supply signal IGW and input of the one-shot pulse signal from the Td delayed one-shot circuit 42 as AND conditions. That is, as a result of the discharge continuation switch SW1 being set to the on-state after the predetermined delay time Td at which the discharge is likely to have been started in the spark gap G from the falling of the IGT signal, power supply from the direct-current power supply B to the auxiliary primary coil 21*b* can be performed.

Furthermore, a result of a comparison between a detection value of the secondary current I2 and the target secondary-current value I2tgt is inputted to the energy supply drive circuit 40 from the secondary-current feedback circuit 61 and added to the AND conditions. Secondary-current feedback control in which the secondary-current value is a target value is performed.

According to the present embodiment, as a result of the auxiliary-primary-coil control circuit 41 on/off-driving either of the energization permission switch SW3 and the changeover switch SW4, the energy supply operation using a portion or all of the auxiliary primary coil 21*b* can be performed. A power supply voltage signal SB is inputted to the auxiliary-primary-coil control circuit 41 from the power supply line L1. Either of the energization permission switch SW3 and the changeover switch SW4 is selected based on the voltage value of the direct-current power supply B that is known from the power supply voltage signal SB.

At this time, the auxiliary-primary-coil control circuit 41 selects either of the energization permission switch SW3 and the changeover switch SW4 by comparing a detected power supply voltage to a voltage threshold Vth that is set in advance. For example, when the power supply voltage is decreased, the energy supply operation can be performed as a result of the changeover switch SW4 being selected and only a portion of the auxiliary primary coil 21*b* being energized.

Here, this energization is implemented by the turn ratio or the like being set in advance so that a voltage that is generated in the portion of the auxiliary primary coil 21*b* that is selected is lower than the power supply voltage. Energization of the auxiliary primary coil 21*b* is switched in this manner based on actual power supply voltage information that can be supplied from the direct-current power supply B. Therefore, whether energization of the auxiliary primary coil 21*b* can be performed can be easily determined.

In addition, a feedback signal SFB is inputted to the auxiliary-primary-coil control circuit 41 from the secondary-current feedback circuit 61 of the feedback control unit 6. The set value of the target secondary-current value I2tgt that is detected by the target secondary-current-value detection circuit 5 is inputted to the secondary-current feedback circuit 61.

A result of a comparison to a detection value of the secondary current I2 based on the secondary-current detection resistor R1 is outputted to the auxiliary-primary-coil control circuit 41. When the energy supply operation is being performed, the secondary-current feedback circuit 61 performs threshold determination of the detected secondary current I2 and performs feedback to open/close driving of the discharge continuation switch SW1 in the energy supply drive circuit 40.

The output signal lines L2 and L3 are connected to an input terminal of the target secondary-current-value detection circuit 5. The main ignition signal IGT and the energy supply signal IGW from the engine ECU 100 are each inputted to the input terminal of the target secondary-current-value detection circuit 5.

At this time, the target secondary-current value I2tgt at the time of the energy supply operation is given as the pulse waveform information of the main ignition signal IGT and the energy supply signal IGW, such as a phase difference in rising. The target secondary-current-value detection circuit 5 outputs, to the secondary-current feedback circuit 61, a command signal for the target secondary-current value I2tgt that is set in advance, in correspondence to the phase difference in the rising of the main ignition signal IGT and the energy supply signal IGW.

In this manner, as shown in FIG. 2, the energy supply operation can be performed during a period in which the energy supply signal IGW is being outputted and while the discharge continuation switch SW1 is in the on/off-state. Furthermore, as a result of either of the energization permission switch SW3 and the changeover switch SW4 being selectively driven, switching of energization of all or a portion of the auxiliary primary coil 21*b* can be performed. When all of the auxiliary primary coil 21*b* is energized, the energization permission switch SW3 is selected. When a portion of the auxiliary primary coil 21*b* is energized, the changeover switch SW4 is selected.

The other of the energization permission switch SW3 and the changeover switch SW4 that is not selected is in the off-state during the energy supply operation. When the energy supply operation is not performed, the discharge continuation switch SW1, the energization permission switch SW3, and the changeover switch SW4 are all in the off-state.

A switching process for the auxiliary primary coil 21*b* that is performed by the auxiliary-primary-coil control circuit 41 will be described with reference to a flowchart shown in FIG. 3, with reference to FIG. 2.

Figure 3:
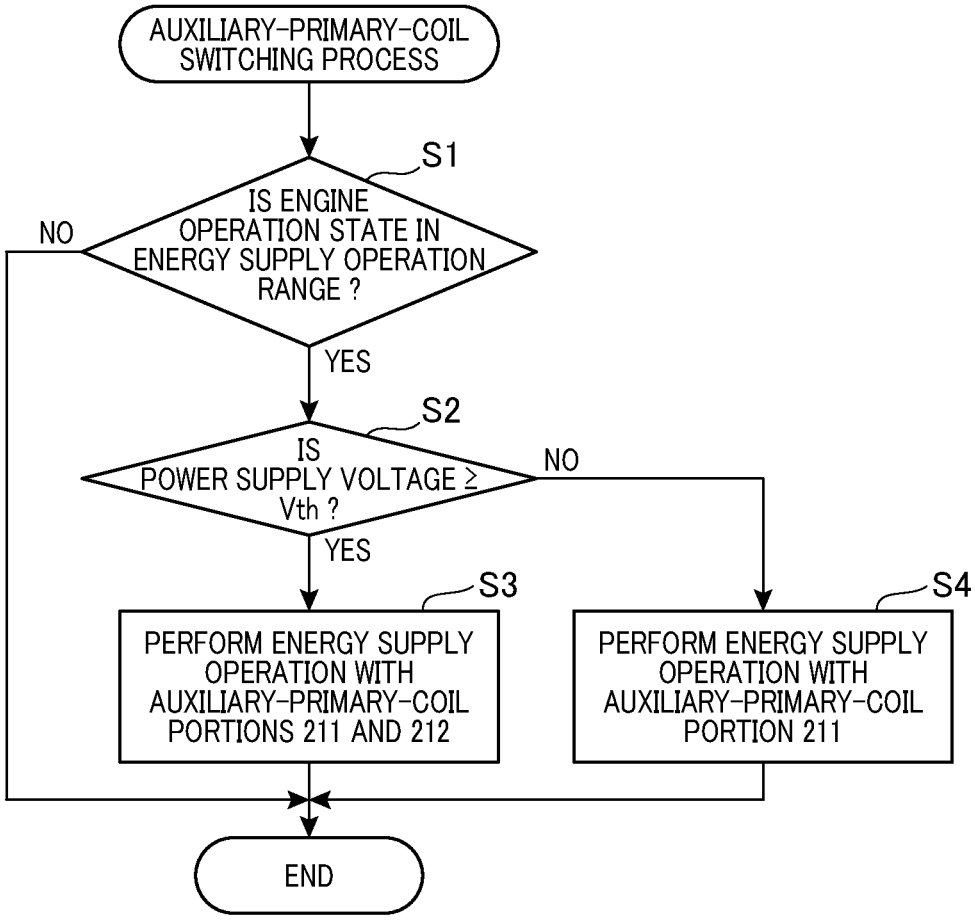
FIG. 3 is a flowchart of an auxiliary-primary-coil switching process performed by an auxiliary-primary-coil control circuit of the ignition apparatus according to the first embodiment.

In FIG. 3, when the switching process for the auxiliary primary coil 21*b* is started, first, at step S1, the auxiliary-primary-coil control circuit 41 determines whether an engine operation state is in an energy supply operation range that is set in advance. When a negative determination is made at step S1, the present process is temporarily ended. For example, whether the engine operation state is in the energy supply operation range can be determined in the ignition apparatus 10 based on a presence/absence of input of the set value of the target secondary-current value I2tgt based on the energy supply signal IGW or input of the energy supply signal IGW, a presence/absence of input of the feedback signal SFB, and the like.

In this case, as indicated as a main ignition signal IGT(1) in FIG. 2, the energy supply operation is not performed after the main ignition operation. That is, when the main ignition switch SW2 is driven on/off synchronously with the main ignition signal IGT(1), and the primary current I1 is interrupted at the falling of the main ignition signal IGT(1), the secondary current I2 flows. Following the main ignition signal IGT(1), the energy supply signal IGW is not outputted. The discharge continuation switch SW1, the energization permission switch SW3, and the changeover switch SW4 remain off, and the secondary current I2 gradually decreases.

When an affirmative determination is made at step S1, the auxiliary-primary-coil control circuit 41 proceeds to step S2. The auxiliary-primary-coil control circuit 41 receives the power supply voltage signal SB and determines whether the power supply voltage is equal to or greater than the predetermined voltage threshold Vth (that is, is power supply voltage ≥Vth?).

When an affirmative determination is made at step S2, the auxiliary-primary-coil control circuit 41 determines that the power supply voltage can be applied to all of the auxiliary primary coil 21*b* and proceeds to step S3. At step S3, the auxiliary-primary-coil control circuit 41 performs the energy supply operation using both of the auxiliary-primary-coil portions 211 and 212.

In this case, as indicated as a main ignition signal IGT(2) in FIG. 2, the energy supply operation is performed after the main ignition operation. That is, the main ignition switch SW2 is driven on/off synchronously with the main ignition signal IGT(2).

When the primary current I1 is interrupted at the falling of the main ignition signal IGT(2), the secondary current I2 flows. As a result of the energy supply signal IGW being outputted before the foregoing, a one-shot pulse signal that has a predetermined pulse width is outputted to the energy supply drive circuit 40 after the predetermined delay time Td from the falling of the main ignition signal IGT(2).

The discharge continuation switch SW1 is driven on/off by the AND operation of the Td delayed one-shot pulse signal and on/off-signals from the secondary-current feedback circuit 61. The discharge continuation switch SW1 is alternately turned on and off until the falling of the energy supply signal IGW. During this time, as a result of the energization permission switch SW3 being on-operated, the secondary current I2 is superimposed.

That is, the start of energy supply is after the delay time Td from the falling of the main ignition signal IGT at which the Td delayed one-shot pulse signal is outputted. When the output from the secondary-current feedback circuit 61 becomes L level, energy supply is temporarily stopped. The end of the energy supply period is when the energy supply signal IGW or the Td delayed one-shot pulse signal becomes L level.

As a result, a current that has the same polarity as the secondary current I2 that flows as a result of the main ignition operation is superimposed on the secondary current I2, and the spark discharge is maintained. During the energy supply period that is the switching operation state of the discharge continuation switch SW1, the on-operation of the energization permission switch SW3 is continued. Feedback control is performed so that the detection value of the secondary current I2 becomes the target secondary-current value I2tgt. The changeover switch SW4 is turned off during the main ignition operation and the energy supply operation. Subsequently, the present process is temporarily ended.

When a negative determination is made at step S2, the auxiliary-primary-coil control circuit 41 determines that energy supply can be performed if the power supply voltage is applied to only a portion of the auxiliary primary coil 21*b*, and proceeds to step S4. At step S4, the auxiliary-primary-coil control circuit 41 performs the energy supply operation using the changeover switch SW4 and the discharge continuation switch SW1 to energize only the auxiliary-primary-coil portion 211 of the auxiliary primary coil 21*b*.

In this case as well, as indicated as the main ignition signal IGT(2) in FIG. 2, the energy supply operation is performed after the main ignition operation. That is, as a result of the energy supply signal IGW being outputted following the main ignition signal IGT(2), the discharge continuation switch SW1 is in the on/off-state after the predetermined delay time Td from the falling of the main ignition signal IGT(2). Simultaneously, as a result of the changeover switch SW4 being on-operated, the secondary current I2 is superimposed.

As a result, a current that has the same polarity as the secondary current I2 that flows as a result of the main ignition operation is superimposed on the secondary current I2, and the spark discharge is maintained. During the energy supply period in which the discharge continuation switch SW1 is in a switching state, the on-operation of the changeover switch SW4 is continued. Feedback control is performed so that the detection value of the secondary current I2 becomes the target secondary-current value I2tgt. The energization permission switch SW3 is turned off during the main ignition operation and the energy supply operation. Subsequently, the present process is temporarily ended.

Here, a relationship between the turn ratio of the auxiliary primary coil 21*b* and the secondary coil 22, and the power supply voltage for enabling the energy supply operation will be described.

In general, to enable the energy supply operation after the main ignition operation, the power supply voltage is required be higher than a voltage that is generated at the auxiliary primary coil 21*b* in accompaniment with changes in magnetic flux in the secondary coil 22 as a result of the main ignition operation.

As an example, when a secondary voltage (referred to, hereafter, as a discharge maintenance voltage, as appropriate) V2 after discharge is started in the spark gap G of the spark plug P is 2 kV, the secondary current (referred to, hereafter, as a discharge maintenance current) I2 is 100 mA, a resistance value of the secondary coil 22 is 7 kΩ, and the turn ratio of the auxiliary primary coil 21*b* and the secondary coil 22 is 300, a terminal voltage on the power supply line L1 side of the auxiliary primary coil 21*b* that serves as the energy supply side can be converted by expression 1, below.

$$(2\text{ kV}+100\text{ mA}\times 7\text{ k}\Omega)/300=9\text{ V} \qquad \text{Expression 1:}$$

Furthermore, to enable the energy supply operation, a saturation voltage of each element on a power supply path to the terminal of the auxiliary primary coil 21*b* on the energy supply side and an amount of drop at the auxiliary primary coil 21*b* are required to be added to the terminal voltage obtained by expression 1. For example, when an open/close switch and a diode are included on the power supply path, when the saturation voltage of the open/close switch is 0.9 V, a forward-direction voltage Vf of the diode 11 is 0.9 V, and the resistance value of the auxiliary primary coil 21*b* is 67 mΩ, the power supply voltage that enables energy supply can be converted by expression 2, below.

$$9\text{ V}+0.9\text{ V}+0.9\text{ V}+67\text{ m}\Omega\times 100\text{ mA}\times 300=12.8\text{ V} \qquad \text{Expression 2:}$$

For example, from expression 2, when the turn ratio is 300, the power supply voltage that enables energy supply is 12.8 V. It is clear that the energy supply operation becomes difficult below 12.8 V.

In addition, as shown in Table 1, below, of an example of trial calculations when the turn ratio is changed, the terminal voltage that is calculated by expression 1 decreases and the power supply voltage that is calculated by expression 2 also decreases, as the turn ratio increases. In this case as well, the discharge voltage V2 is 2 kV, the discharge current I2: 100 mA. For example, changes in an energy-supply-enabling voltage, a primary coil current Ilnet, and the resistance value of the auxiliary primary coil 21*b* at turn ratios ranging from 100 to 1000 are also shown.

TABLE 1

| | | | | | | | |
|---|---|---|---|---|---|---|---|
| Turn ratio (Secondary coil/auxiliary primary coil) | 1000 | 900 | 700 | 500 | 300 | 200 | 100 |
| Auxiliary-primary-coil current (I2 = 100 mA) | 100 | 90 | 70 | 50 | 30 | 20 | 10 |
| Auxiliary-primary-coil terminal voltage (V2 = 2 kV) | 2.7 | 3 | 3.9 | 5.4 | 9 | 13.5 | 27 |
| Energy-supply-enabling power supply voltage (V) | 6.5 | 6.8 | 7.7 | 9.2 | 12.8 | 17.3 | 30.8 |
| Number of turns T of auxiliary primary coil (40 mΩ/20 T) | 10 | 11.1 | 14.3 | 20 | 33.3 | 50 | 100 |
| Auxiliary-primary-coil resistance (40 mΩ/20 T) | 0.02 | 0.02 | 0.03 | 0.04 | 0.07 | 0.1 | 0.2 |

From Table 1, for example, when the power supply voltage decreases from an ordinary voltage (such as 14 V) for some reason, to enable energy supply even at 6.5 V, the turn ratio is required to be 1000. However, when the power supply voltage returns to the ordinary voltage in this state, the primary coil current Ilnet that flows through the auxiliary primary coil 21*b* becomes a large current as calculated by expression 3, below.

$$(14\text{ V}-0.8\text{ V}-0.8\text{ V})/0.02\Omega=620\text{ A} \qquad \text{Expression 3:}$$

In this case, an issue arises in that, to ensure current capacity and heat dissipation of each element on the power supply path and the auxiliary primary coil 21*b*, increase in size and cost of the apparatus occurs and feasibility decreases.

In this regard, the ignition apparatus 10 according to the present embodiment includes two auxiliary-primary-coil portions 211 and 212 in the auxiliary primary coil 21*b*. Therefore, the turn ratio can be made variable as a result of either of the auxiliary-primary-coil portions 211 and 212 or both being energized based on the power supply voltage. That is, when the power supply voltage is less than the voltage threshold Vth, only the one auxiliary-primary-coil portion 211 is selected and the turn ratio is increased. As a result, energy supply by the energy supply circuit unit 4 can be performed.

In addition, when the power supply voltage is equal to or greater than the voltage threshold Vth, both of the auxiliary-primary-coil portions 211 and 212 are selected and the turn ratio is decreased. As a result, energy supply can be performed while a large current can be kept from flowing. In this manner, as a result of the auxiliary primary coil 21*b* being switchable based on the power supply voltage that can be applied, energy supply can be performed over a wide operation range. Ignitability can be improved.

In addition, the ignition apparatus 10 is provided with the Td delayed one-shot circuit 42 that restricts the energy supply time. Therefore, a maximum time of energization of the auxiliary primary coil 21*b* can be set in advance based on the specifications of the ignition apparatus 10. The ignition apparatus 10 can be protected. In particular, a protective function against cases in which the current to the auxiliary primary coil 21*b* increases when the power supply voltage decreases can be provided.

Furthermore, the ignition apparatus 10 is provided with the target secondary-current-value detection circuit 5 and the feedback control unit 6. Therefore, feedback control of the detection value of the secondary current I2 can be performed and the detection value of the secondary current I2 can be maintained at the target secondary-current value I2tgt while the energy supply operation is being performed.

At this time, the target secondary-current value I2tgt is indicated by the phase difference between the main ignition signal IGT and the energy supply signal IGW. Therefore, feedback control of the secondary current I2 can be performed without increase in signal lines between the engine ECU 100 and the ignition apparatus 10, and signal terminals provided in each apparatus.

In addition, to perform feedback control of the secondary current I2 based on the target secondary-current value I2tgt, as the secondary-current feedback circuit 61, for example, a current feedback control circuit configuration described in JP-A-2015-200300 can be used.

Specifically, the configuration can be implemented by the secondary-current feedback circuit 61 being provided with a comparison circuit for comparing the detected secondary current I2 to a threshold and a switching means for switching the threshold, and a detection signal from the target secondary-current-value detection circuit 5 being supplied as the threshold. The detection signal of the secondary current I2 that is subjected to voltage conversion by the secondary-current detection resistor R1 and either of an upper-limit threshold and a lower-limit threshold are inputted to the comparison circuit, so as to be switched as appropriate. The discharge continuation switch SW1 is open/close-driven based on the determination result. For example, the upper-limit threshold and the lower-limit threshold are set with the target secondary-current value I2tgt as a center. The upper-limit threshold is selected when the discharge continuation switch SW1 is close-driven and the secondary current I2 is increasing. The lower-limit threshold is selected when the discharge continuation switch SW1 is open-driven and and the secondary current I2 is decreasing.

At this time, in the energy supply drive circuit 40, for example, an AND circuit for the energy supply signal IGW, the pulse output from the Td delayed one-shot circuit, and the feedback signal SFB that is the secondary-current comparison result is provided to drive the discharge continuation switch SW1.

For example, the feedback signal SFB becomes L level when the detection signal is greater than the upper-limit threshold and H level when the detection signal is less than the lower-limit threshold. That is, the configuration is such that, when the energy supply signal IGW is outputted and the pulse output from the Td delayed one-shot circuit is performed, the discharge continuation switch SW1 is turned on if the secondary current I2 falls below the lower-limit threshold, and turned off if the secondary current I2 exceeds the upper-limit threshold, and the energy supply operation is performed.

As described above, according to the present embodiment, the auxiliary primary coil 21*b* is configured by the plurality of auxiliary-primary-coil portions 211 and 212. Connection with the direct-current power supply B is switched based on the voltage value of the direct-current power supply B. Therefore, the energy supply operation following the main ignition operation can be optimally controlled. Consequently, a compact, high-performance ignition apparatus 10 for an internal combustion engine can be implemented.

According to the present embodiment, a method for switching the connection between the plurality of auxiliary-primary-coil portions 211 and 212 and the direct-current power supply B inside the ignition apparatus 10 by the energy supply circuit unit 4, based on the voltage value of the direct-current power supply B is described.

However, other methods may be used. For example, the plurality of auxiliary-primary-coil portions 211 and 212 can be switched based on the terminal voltage on the energy supply side of the auxiliary primary coil 21*b* or the discharge maintenance voltage of the spark plug P, or based on the pulse waveform information of the main ignition signal IGT and the energy supply signal IGW.

Furthermore, the plurality of auxiliary-primary-coil portions 211 and 212 can be switched based on the operation state of the engine, such as either of an engine rotation frequency and an engine load or both, or based on a temperature of the ignition coil 2. The plurality of auxiliary-primary-coil portions 211 and 212 can also be switched based on a combination of the foregoing. Alternatively, the engine ECU 100 can make a determination and instruct the ignition apparatus 10. These methods will be described next.

Second Embodiment

An ignition apparatus for an internal combustion engine according to a second embodiment will be described with reference to FIG. 4 to FIG. 6.

According to the present embodiment as well, a basic configuration of the ignition control apparatus 1 that includes the ignition apparatus 10 and the engine ECU 100 is similar to that according to the above-described first embodiment. The present embodiment differs in that, in the energy supply circuit unit 4, a terminal voltage on a low voltage side of the main primary coil 21*a* is used to switch the plurality of auxiliary-primary-coil portions 211 and 212. Differences will mainly be described, below.

Here, among reference numbers used according to the second and subsequent embodiments, reference numbers that are the same as those used according to a previous embodiment indicate constituent elements and the like that are similar to those according to the previous embodiment, unless otherwise stated.

Figure 4:
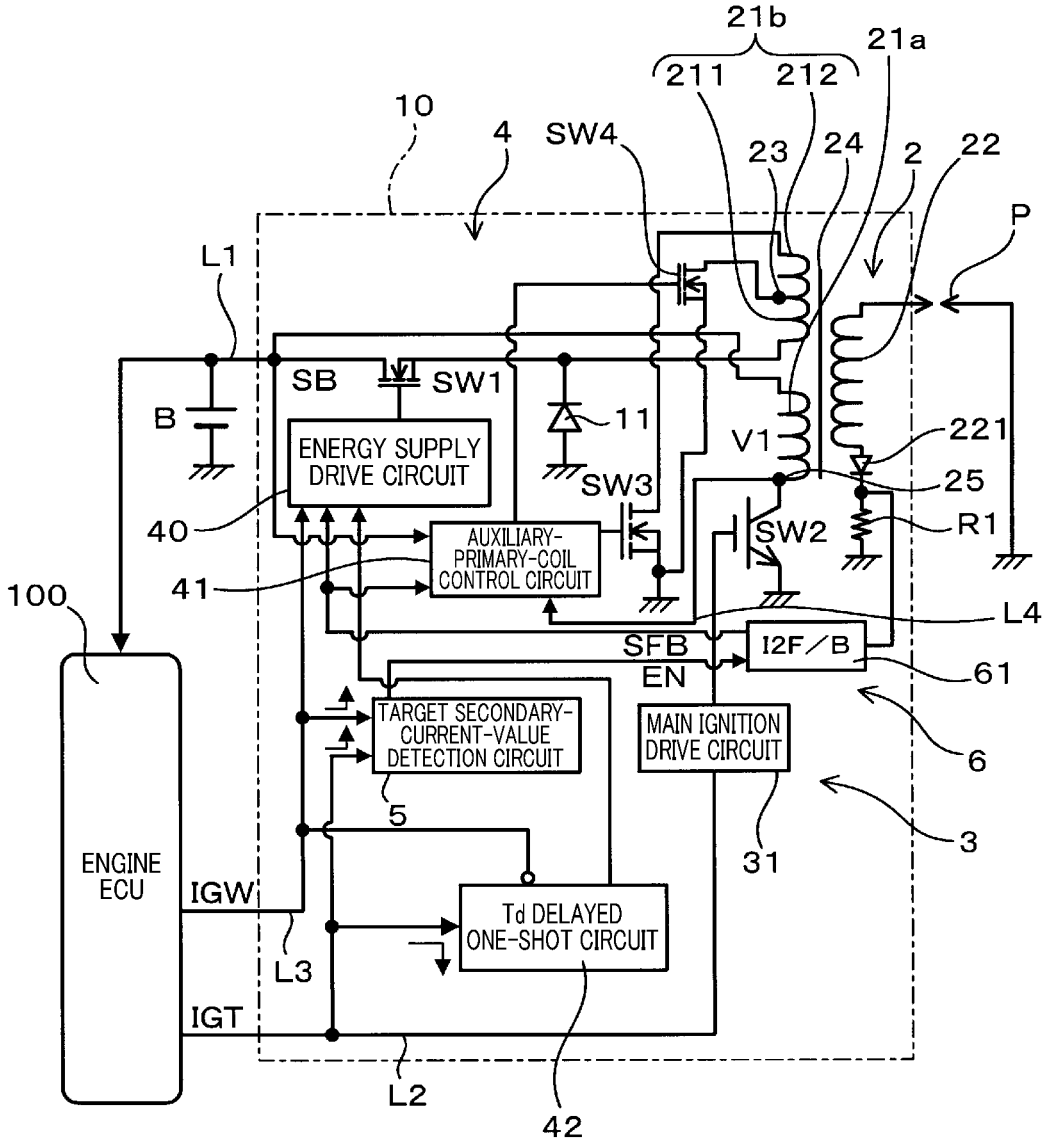
FIG. 4 is a circuit configuration diagram of an ignition control apparatus to which an ignition apparatus for an internal combustion engine according to a second embodiment is applied.

As shown in FIG. 4, according to the present embodiment, a grounding-side terminal 25 that serves as the low voltage side of the main primary coil 21*a* and the auxiliary-primary-coil control circuit 41 are connected by a signal line L4. A detection signal of a terminal voltage (referred to, hereafter, as a main-primary-coil terminal voltage) V1 at the grounding-side terminal 25 is inputted to the auxiliary-primary-coil control circuit 41.

The auxiliary-primary-coil control circuit 41 can estimate a terminal voltage (referred to, hereafter, as an auxiliary-primary-coil terminal voltage) on the energy supply side of the auxiliary primary coil 21*b* from the main-primary-coil terminal voltage V1, based on the turn ratio of the main primary coil 21*a* and the auxiliary primary coil 21*b*. The auxiliary-primary-coil terminal voltage Vs is a power-supply-side terminal voltage that is connected to the power supply line L1. As a result of a comparison to the power supply voltage signal SB that is inputted to the auxiliary-primary-coil control circuit 41 from the power supply line L1, whether energy supply can be performed can be determined.

A switching process for the auxiliary primary coil 21*b* that is performed by the auxiliary-primary-coil control circuit 41 in this case will be described with reference to a flowchart shown in FIG. 5.

Figure 5:
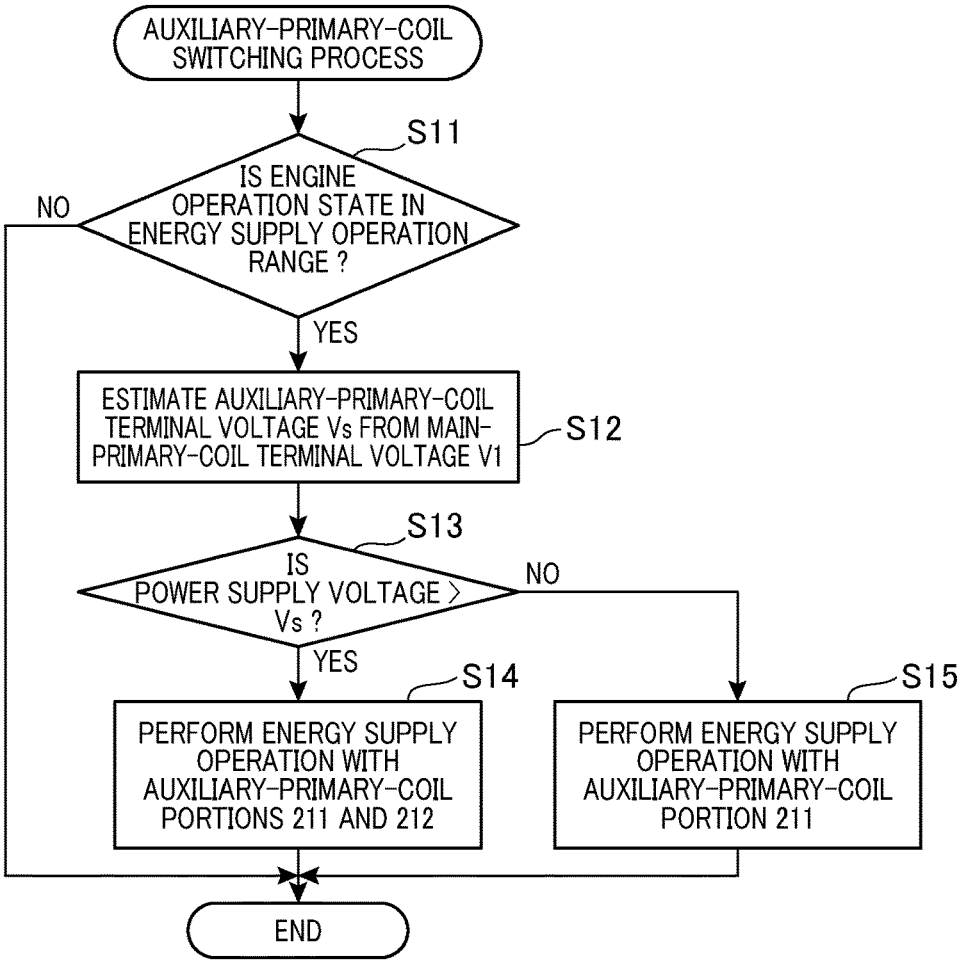
FIG. 5 is a flowchart of an auxiliary-primary-coil switching process performed by an auxiliary-primary-coil control circuit of the ignition apparatus according to the second embodiment.

In FIG. 5, when the switching process for the auxiliary primary coil 21*b* is started, first, at step S11, the auxiliary-primary-coil control circuit 41 determines whether the engine operation state is in the energy supply operation range that is set in advance, based on the energy supply signal IGW or the like. When a negative determination is made at step S11, the present process is temporarily ended.

When an affirmative determination is made at step S11, the auxiliary-primary-coil control circuit 41 proceeds to step S12 and receives a detection voltage signal at the grounding-side terminal 25 of the main primary coil 21*a* during discharge generated by the main ignition operation from the signal line L4. Then, the auxiliary-primary-coil control circuit 41 estimates the auxiliary-primary-coil terminal voltage Vs on the energy supply side of the auxiliary primary coil 21*b* based on the detected main-primary-coil terminal voltage V1 and the turn ratio of the main primary coil 21*a* and the auxiliary primary coil 21*b* that is known in advance.

At this time, the primary coil 21 that includes the main primary coil 21*a* and the auxiliary primary coil 21*b*, and the secondary coil 22 are coupled by a magnetic circuit. When all of the primary coil 21 is in a no-load state, a voltage based on the turn ratio is generated in each of the primary coil 21, in relation to a secondary voltage V2 of the secondary coil 22.

Figure 6:
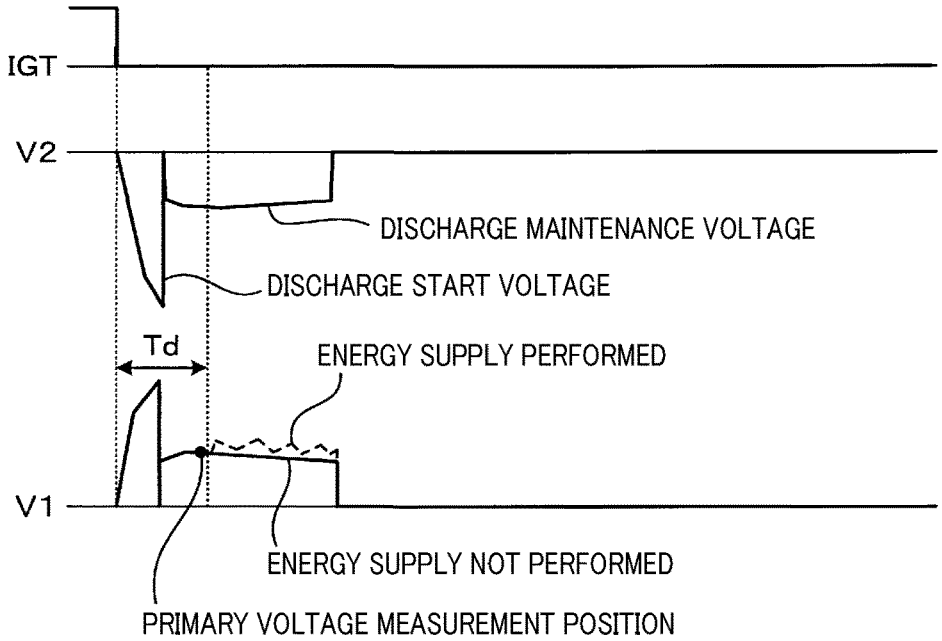
FIG. 6 is a time chart of transitions in a primary voltage and a secondary voltage after a main ignition operation, according to the second embodiment.

The main-primary-coil terminal voltage V1 may be detected during the period in which all of the primary coil 21 is in the no-load state, as shown in FIG. 6, using the foregoing principle. Specifically, during a waiting period (that is, the delay time Td) from when the primary current of the main primary coil 21*a* is interrupted until energy supply by the auxiliary primary coil 21*b*, both of the main primary coil 21*a* and the auxiliary primary coil 21*b* have no loads from when discharge is started until before energy supply is started.

Therefore, as a result of the main-primary-coil terminal voltage V1 being measured at the end of the delay time Td (that is, indicated as a primary voltage measurement position in FIG. 6), for example, at which the main primary coil 21*a* that is in the no-load state and the auxiliary primary coil 21*b* that is in the no-load state are both present, and energy supply being started after selective use of the auxiliary primary coil 21*b* is determined, the auxiliary-primary-coil terminal voltage Vs can be accurately estimated from the turn ratio of each coil.

Here, when energy supply is performed after the delay time Td, the voltage that is generated in the auxiliary primary coil 21*b* is also superimposed (that is, indicated by a dotted line in FIG. 6) on the voltage at the main primary coil 21*a* (that is, indicated by a solid line in FIG. 6). Therefore, detection of the main-primary-coil terminal voltage V1 is preferably performed in a state before the start of energy supply in which not only the main primary coil 21*a* but also the auxiliary primary coil 21*b* has no load.

Subsequently, the auxiliary-primary-coil control circuit 41 proceeds to step S13. The auxiliary-primary-coil control circuit 41 receives the power supply voltage signal SB and determines whether the power supply voltage is higher than the estimated auxiliary-primary-coil terminal voltage Vs (that is, is power supply voltage >Vs?).

When an affirmative determination is made at step S13, the auxiliary-primary-coil control circuit 41 proceeds to step S14. In this case, the power supply voltage can be applied to all of the auxiliary primary coil 21*b*. The energy supply operation is performed using both of the auxiliary-primary-coil portions 211 and 212 (for example, see FIG. 2). Subsequently, the present process is temporarily ended.

When a negative determination is made at step S13, the auxiliary-primary-coil control circuit 41 proceeds to step S15. In this case, the power supply voltage can be applied to a portion of the auxiliary primary coil 21*b*. The energy supply operation is performed using only the auxiliary-primary-coil portion 211 (for example, see FIG. 2). Subsequently, the present process is temporarily ended.

According to the present embodiment, the auxiliary-primary-coil terminal voltage Vs that is on the energy supply side of the auxiliary primary coil 21*b* can be accurately estimated from the measurement value of the main-primary-coil terminal voltage V1.

In addition, as a result of the estimated auxiliary-primary-coil terminal voltage Vs being compared to the power supply voltage, whether energy supply to the auxiliary-primary-coil portions 211 and 212 can be performed can be accurately determined. That is, because a portion or all of the auxiliary primary coil 21*b* that has a lower voltage than the power supply voltage is used, the energy supply operation can be performed without interruption.

Consequently, the energy supply operation that follows the main ignition operation can be optimally controlled. A compact, high-performance ignition apparatus 10 for an internal combustion engine can be implemented.

Here, the estimation of the auxiliary-primary-coil terminal voltage Vs is not limited to the method described above. An arbitrary method can be used. For example, the secondary voltage (discharge maintenance voltage) of the secondary coil 22 may be estimated from the turn ratio of the secondary coil 22 and the main primary coil 21*a*, based on the measurement value of the main-primary-coil terminal voltage V1. The auxiliary-primary-coil terminal voltage Vs may be further estimated from the turn ratio of the secondary coil 22 and the auxiliary primary coil 21*b*.

In addition, the power supply voltage and the auxiliary-primary-coil terminal voltage Vs are not necessarily required to be used for switching of the plurality of auxiliary-primary-coil portions 211 and 212. The discharge maintenance voltage of the spark plug P may be used.

For example, increase in the auxiliary-primary-coil terminal voltage Vs occurs as a result of the discharge maintenance voltage increasing as a result of environmental changes in the periphery of the spark gap G. Therefore, switching of the auxiliary primary coil 21*b* set in advance may be performed each time based on the measurement result of the discharge maintenance voltage during ordinary operation. The discharge maintenance voltage may be a measurement value or an estimation value.

As described above, for example, the discharge maintenance value can be estimated from the measurement value of the main-primary-coil terminal voltage V1. In addition, according to the above-described first and second embodiments, switching based on a comparison of a value of the power supply voltage and a value of the discharge maintenance voltage may be performed, in a manner similar to the comparison of the power supply voltage to the voltage threshold Vth or the auxiliary-primary-coil terminal voltage Vs.

Third Embodiment

An ignition apparatus for an internal combustion engine according to a third embodiment will be described with reference to FIG. 7 to FIG. 9.

According to the present embodiment as well, a basic configuration of the ignition control apparatus 1 that includes the ignition apparatus 10 and the engine ECU 100 is similar to that according to the above-described first embodiment. The present embodiment differs in that the main ignition signal IGT and the energy supply signal IGW that are signals transmitted from the engine ECU 100 are used in the energy supply circuit unit 4 to switch the plurality of auxiliary-primary-coil portions 211 and 212 of the auxiliary primary coil 21*b*.

Specifically, the pulse waveform information of the main ignition signal IGT and the energy supply signal IGW, such as a phase difference of the two signals is used. Differences will mainly be described, below.

Figure 7:
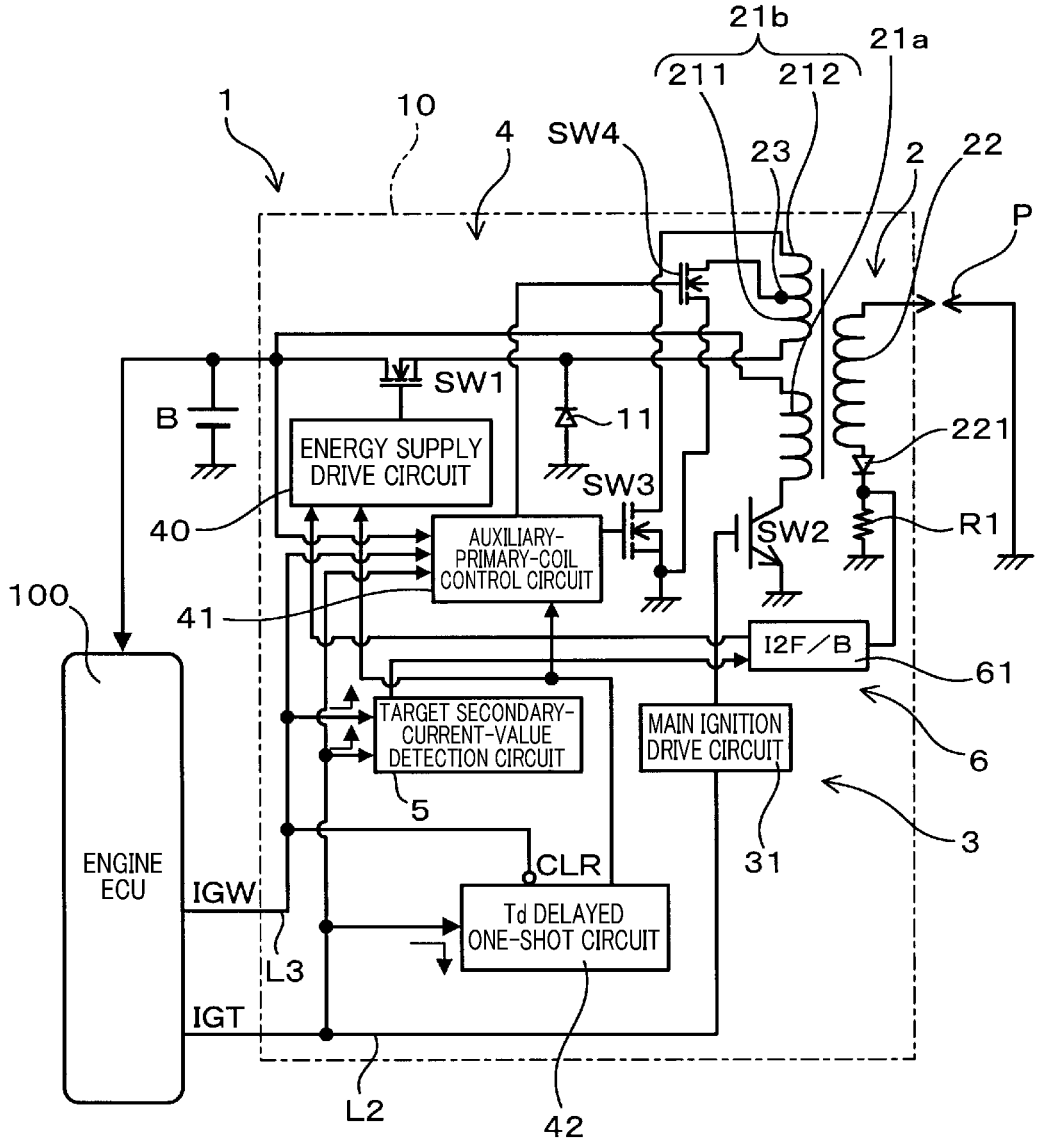
FIG. 7 is a circuit configuration diagram of an ignition control apparatus to which an ignition apparatus for an internal combustion engine according to a third embodiment is applied.

As shown in FIG. 7, according to the present embodiment, the main ignition signal IGT and the energy supply signal IGW that are outputted from the engine ECU 100 are inputted to the target secondary-current-value detection circuit 5 via the output signal lines L2 and L3, and inputted to the auxiliary-primary-coil control circuit 41. In the auxiliary-primary-coil control circuit 41, the auxiliary primary coil 21*b* that is used during the energy supply operation can be specified using the phase difference between the main ignition signal IGT and the energy supply signal IGW.

Figure 8:
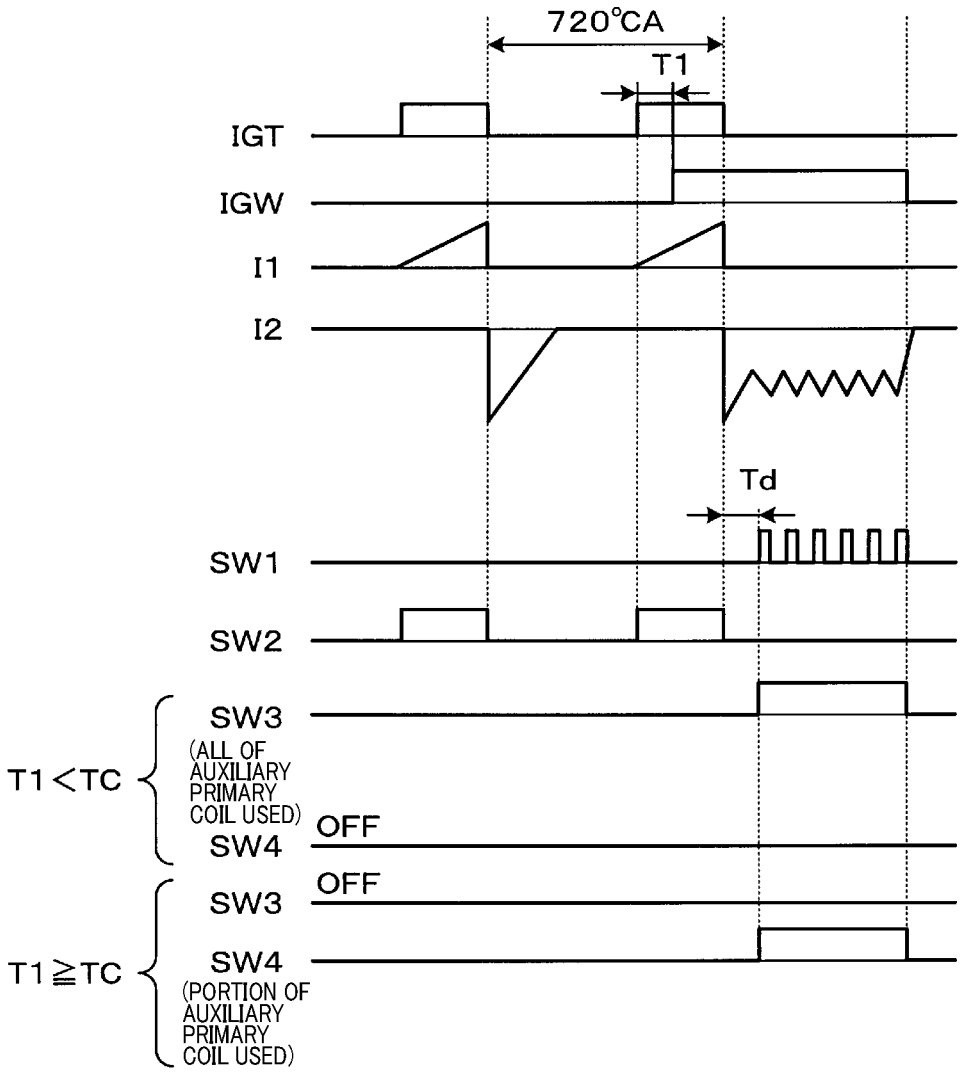
FIG. 8 is a time chart of transitions in a main ignition operation and an energy supply operation according to the third embodiment.

As shown in FIG. 8, for example, these signals are set so that, after the rising of the main ignition signal IGT, the energy supply signal IGW rises with a time difference T1. As a result of this rising time difference T1 being compared to a time threshold TC that is set in advance, switching of the auxiliary primary coil 21*b* can be performed based on the comparison result. For example, when the rising time difference T1 is less than the time threshold TC, the energization permission switch SW can be driven and all of the auxiliary primary coil 21*b* can be used. When the rising time difference T1 is equal to or greater than the time threshold TC, the changeover switch SW4 can be driven and a portion of the auxiliary primary coil 21*b* can be used.

A switching process for the auxiliary primary coil 21*b* that is performed by the auxiliary-primary-coil control circuit 41 in this case will be described with reference to a flowchart shown in FIG. 9.

Figure 9:
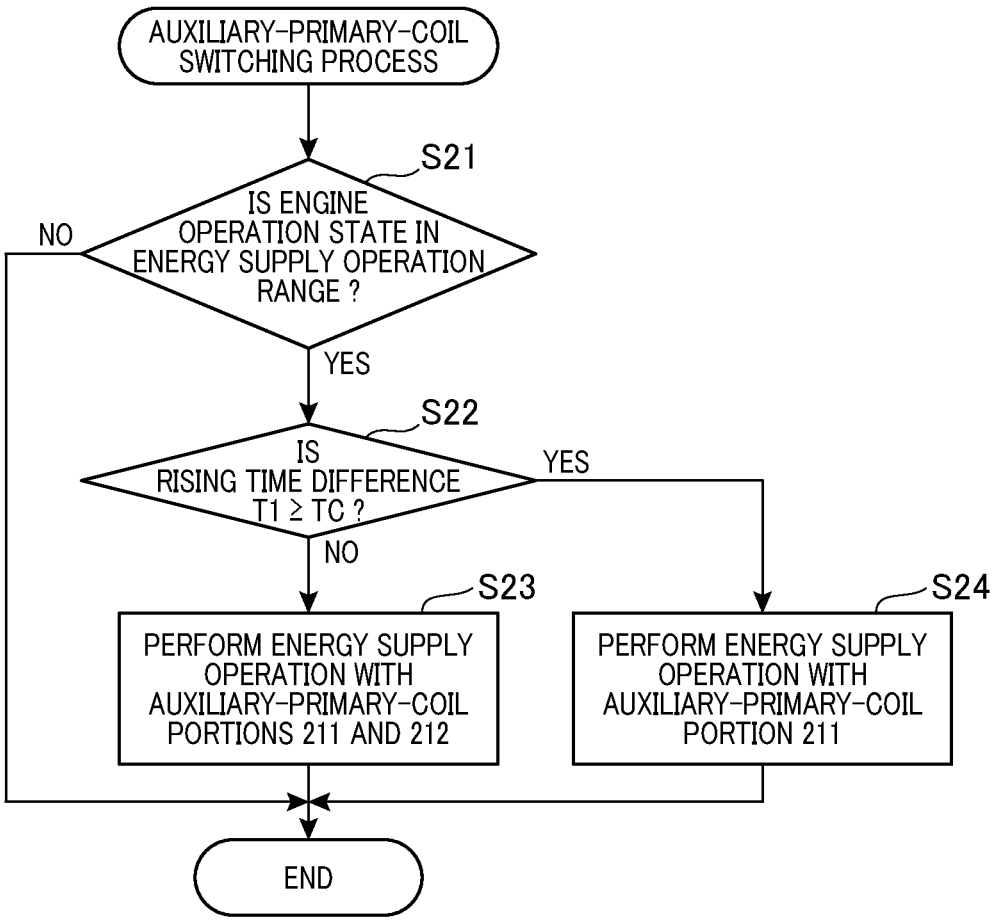
FIG. 9 is a flowchart of an auxiliary-primary-coil switching process performed by an auxiliary-primary-coil control circuit of the ignition apparatus according to the third embodiment.

In FIG. 9, when the switching process for the auxiliary primary coil 21*b* is started, first, at step S21, the auxiliary-primary-coil control circuit 41 determines whether the engine operation state is in the energy supply operation range that is set in advance, based on the presence/absence of the energy supply signal IGW or the like. When a negative determination is made at step S21, the present process is temporarily ended.

When an affirmative determination is made at step S21, the auxiliary-primary-coil control circuit 41 proceeds to step S22. The auxiliary-primary-coil control circuit 41 calculates the rising time difference T1 between the main ignition signal IGT and the energy supply signal IGW, and determines whether the rising time difference T1 is equal to or greater than the predetermined time threshold TC (that is, is rising time difference T1≥TC?).

When a negative determination is made at step S22 (that is, rising time difference T1<TC), the auxiliary-primary-coil control circuit 41 proceeds to step S23. In this case, an instruction is to apply the power supply voltage to all of the auxiliary primary coil 21*b*. The energy supply operation is performed using both of the auxiliary-primary-coil portions 211 and 212 (for example, see FIG. 8). Subsequently, the present process is temporarily ended.

When an affirmative determination is made at step S22, the auxiliary-primary-coil control circuit 41 proceeds to step S24. In this case, the instruction is to apply the power supply voltage to a portion of the auxiliary primary coil 21*b*. The energy supply operation is performed using only the auxiliary-primary-coil portion 211 (for example, see FIG. 8). Subsequently, the present process is temporarily ended.

Here, the output from the Td delayed one-shot circuit 42 that specifies the start of energy supply and a supply maximum period is inputted to the auxiliary-primary-coil control circuit 41. The auxiliary-primary-coil control circuit 41 prevents the effects of the auxiliary primary coil 21*b* from appearing during the main ignition operation by turning off the energization permission switch SW3 and the changeover switch SW4 outside the output period of the Td delayed one-shot pulse.

In addition, the specification of the target secondary-current value I2tgt may be set differently between when the rising time difference T1 is equal to or greater than the time threshold TC and when the rising time difference T1 is less than the time threshold TC. Alternatively, as described hereafter, the phase difference between the two signals can be further divided for each of when the rising time difference T1 is equal to or greater than the time threshold TC and when the rising time difference T1 is less than the time threshold TC, and a differing target secondary-current value I2tgt may be set based on the rising time difference T1.

According to the present embodiment, whether energy supply to the auxiliary-primary-coil portions 211 and 212 can be performed is determined using the main ignition signal IGT and the energy supply signal IGW that are transmitted from the engine ECU 100. The energy supply operation can be performed using a portion or all of the auxiliary-primary-coil portions 211 and 212.

In this case, optimal switching of the auxiliary primary coil 21*b* can be determined and specified, taking into consideration water temperature, a fuel injection amount, an exhaust gas recirculation (EGR) amount, variations in the power supply voltage, and the like in the engine ECU 100.

Therefore, addition of signal lines and signal terminals is not required. Highly accurate control can be implemented with a simple apparatus configuration.

Consequently, the energy supply operation that follows the main ignition operation can be optimally controlled. A compact, high-performance ignition apparatus 10 for an internal combustion engine can be implemented.

Fourth Embodiment

Figure 10:
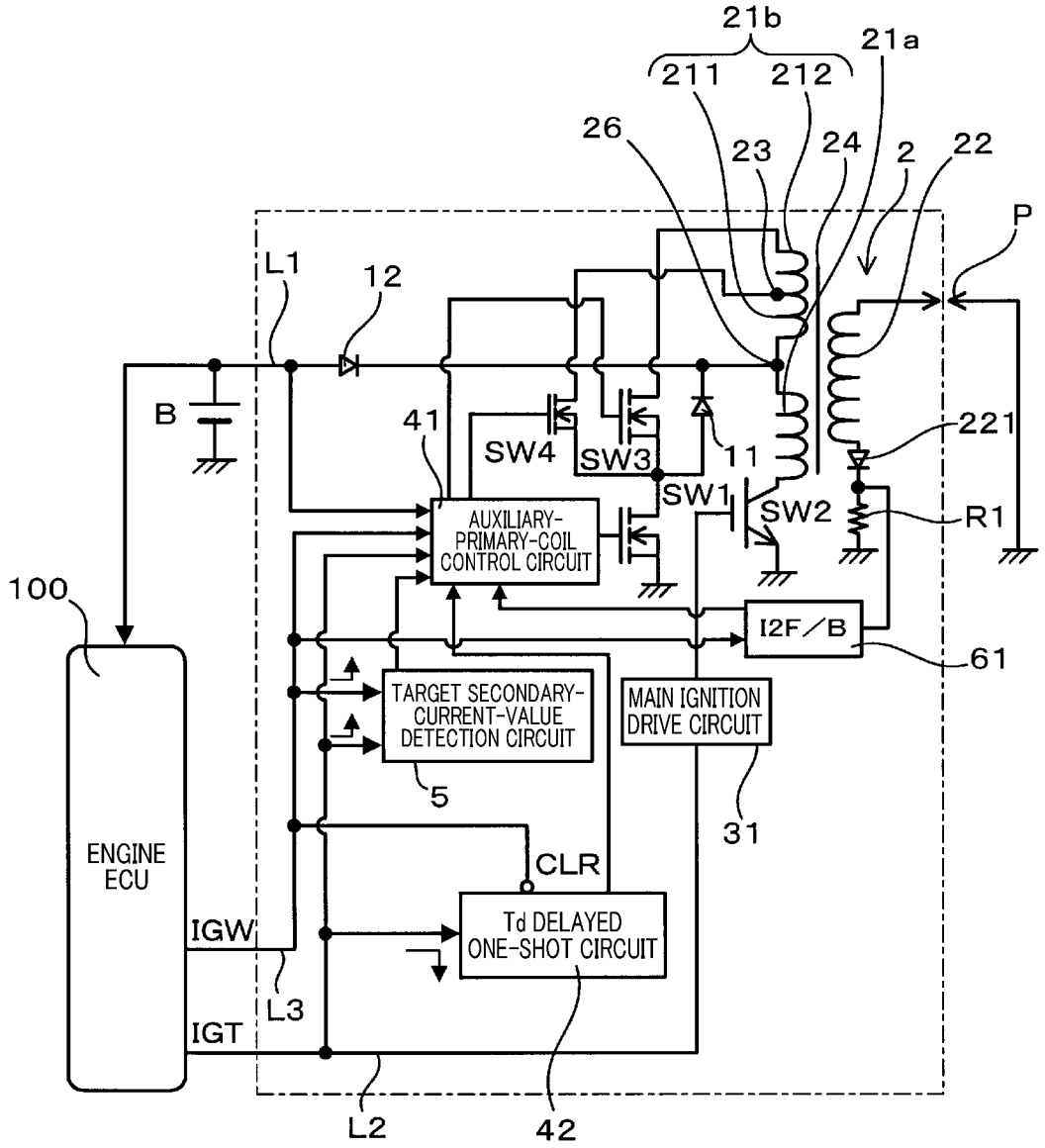
FIG. 10 is a circuit configuration diagram of an ignition control apparatus to which an ignition apparatus for an internal combustion engine according to a fourth embodiment is applied.

An ignition apparatus for an internal combustion engine according to a fourth embodiment will be described with reference to FIG. 10 and FIG. 11.

According to the present embodiment, a basic configuration of the ignition control apparatus 1 that includes the ignition apparatus 10 and the engine ECU 100 is similar to that according to the above-described third embodiment. A circuit configuration for driving the auxiliary primary coil 21*b* in the ignition apparatus 10 differs. A configuration of the engine supply circuit unit 4 for switching the plurality of auxiliary-primary-coil portions 211 and 212 is similar to that according to the above-described third embodiment. Differences will mainly be described, below.

According to the present embodiment as well, the main primary coil 21*a* and the auxiliary primary coil 21*b* are connected in series and also connected in parallel to the direct-current power supply B. Specifically, an intermediate tap 26 is provided between one end of the main primary coil 21*a* and one end of the auxiliary primary coil 21*b*. The power supply line L1 that leads to the direct-current power supply B is connected to the intermediate tap 26. The other end of the main primary coil 21*a* is grounded via the main ignition switch SW2. The other end of auxiliary primary coil 21*b* is grounded via the discharge continuation switch SW1.

The energization permission switch SW3 is connected in series between the discharge continuation switch SW1 and the auxiliary primary coil 21*b*. In addition, the anode terminal of the second diode 11 is connected to the connection point between the discharge continuation switch SW1 and the energization permission switch SW3. The cathode terminal of the second diode 11 is connected to the power supply line L1. As a result, a recirculation path L11 that connects the other end of the auxiliary primary coil 21*b* and the power supply line L1 is formed by switching on of the energization permission switch SW3 being continued when the discharge continuation switch SW1 is off.

In addition, the intermediate tap 23 between the auxiliary-primary-coil portions 211 and 212 is connected to the connection point between the discharge continuation switch SW1 and the energization permission switch SW3, via the changeover switch SW4. As a result, the other end of the auxiliary-primary-coil portion 211 that is connected to the intermediate tap 23 and the power supply line L1 are connected via the recirculation path L11, by switching on of the changeover switch SW4 being continued when the discharge continuation switch SW1 is off.

A third diode 12 is provided on the power supply line L1 between the connection point with the recirculation path L11 and the direct-current power supply B. In the third diode 12, a direction towards the primary coil 21 is a forward direction.

According to the present embodiment as well, in a manner similar to that according to the above-described third embodiment, the main ignition signal IGT and the energy supply signal IGW are inputted to the target secondary-current-value detection circuit 5 via the output signal lines L2 and L3, and also inputted to the auxiliary-primary-coil control circuit 41.

Therefore, in the auxiliary-primary-coil control circuit 41, the auxiliary primary coil 21*b* that is used during the energy supply operation can be switched based on the phase difference between the main ignition signal IGT and the energy supply signal IGW. In addition, in the target secondary-current-value detection circuit 5, the target secondary-current value I2tgt during the energy supply operation can be detected using the phase difference between the main ignition signal IGT and the energy supply signal IGW.

Figure 11:
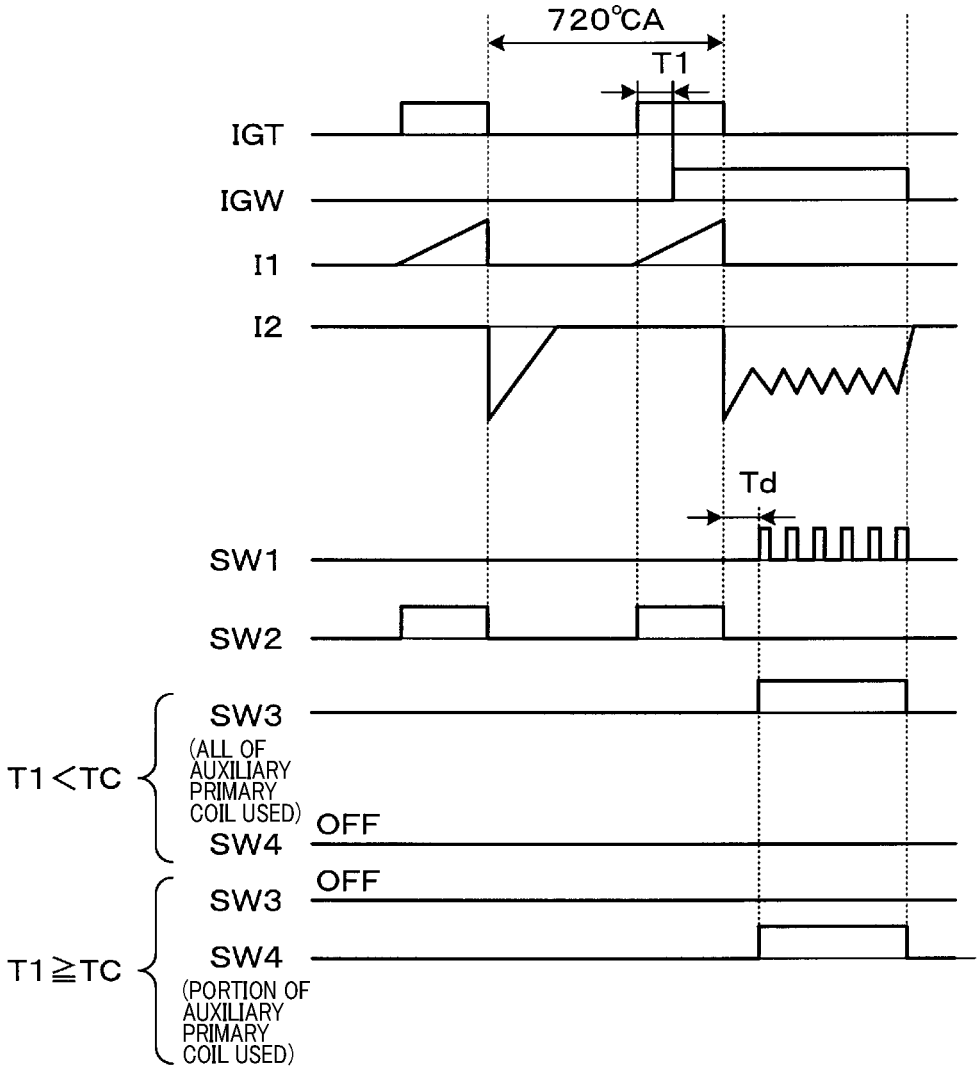
FIG. 11 is a time chart of transitions in a main ignition operation and an energy supply operation according to the fourth embodiment.

In this case as well, as shown in FIG. 11, switching of the auxiliary-primary-coil portions 211 and 212 can be performed using the rising time difference T1 between the main ignition signal IGT and the energy supply signal IGW. That is, when the rising time difference T1 is less than the time threshold TC, the energization permission switch SW3 is driven. The energy supply operation can be performed using all of the auxiliary primary coil 21*b*. In addition, when the rising time difference T1 is equal to or greater than the time threshold TC, the changeover switch SW4 is driven. The energy supply operation can be performed using a portion of the auxiliary primary coil 21*b*.

In the circuit configuration according to the present embodiment, a switching process for the auxiliary primary coil 21*b* that is performed by the auxiliary-primary-coil control circuit 41 is similar to that according to the third embodiment (for example, see FIG. 9). A flowchart is omitted. According to the present embodiment as well, as a result of switching of the auxiliary primary coils 211 and 212 being performed using the rising time difference T1, effects similar to those according to the above-described third embodiment can be achieved.

Consequently, the energy supply operation that follows the main ignition operation can be optimally controlled. A compact, high-performance ignition apparatus 10 for an internal combustion engine can be implemented.

According to the above-described embodiments, the energy supply operation is described as a case in which switching of the auxiliary primary coil 21*b* is performed by the discharge continuation switch SW being switching-driven, and the energization permission switch SW3 or the changeover switch SW4 being driven on/off.

However, switching driving may be performed such that the on state of the energization permission switch SW3 or the changeover switch SW4 is synchronized with the on state of the discharge continuation switch SW1. Driving methods of the discharge continuation switch SW1 and the energization permission switch SW3 and the changeover switch SW4 may be interchanged. The energization permission switch SW3 or the changeover switch SW4 may be switching-driven. In addition, the second diode 11 may be eliminated and the circuit may be simplified.

Fifth Embodiment

An ignition apparatus for an internal combustion engine according to a fifth embodiment will be described with reference to FIG. 12 and FIG. 13.

According to the present embodiment, a basic configuration of the ignition control apparatus 1 that includes the ignition apparatus 10 and the engine ECU 100 is similar to that according to the above-described fourth embodiment. A circuit configuration for driving the auxiliary primary coil 21*b* in the ignition apparatus 10 differs. A configuration of the engine supply circuit unit 4 for switching the plurality of auxiliary-primary-coil portions 211 and 212 is similar to that according to the above-described fourth embodiment. Differences will mainly be described, below.

Figure 12:
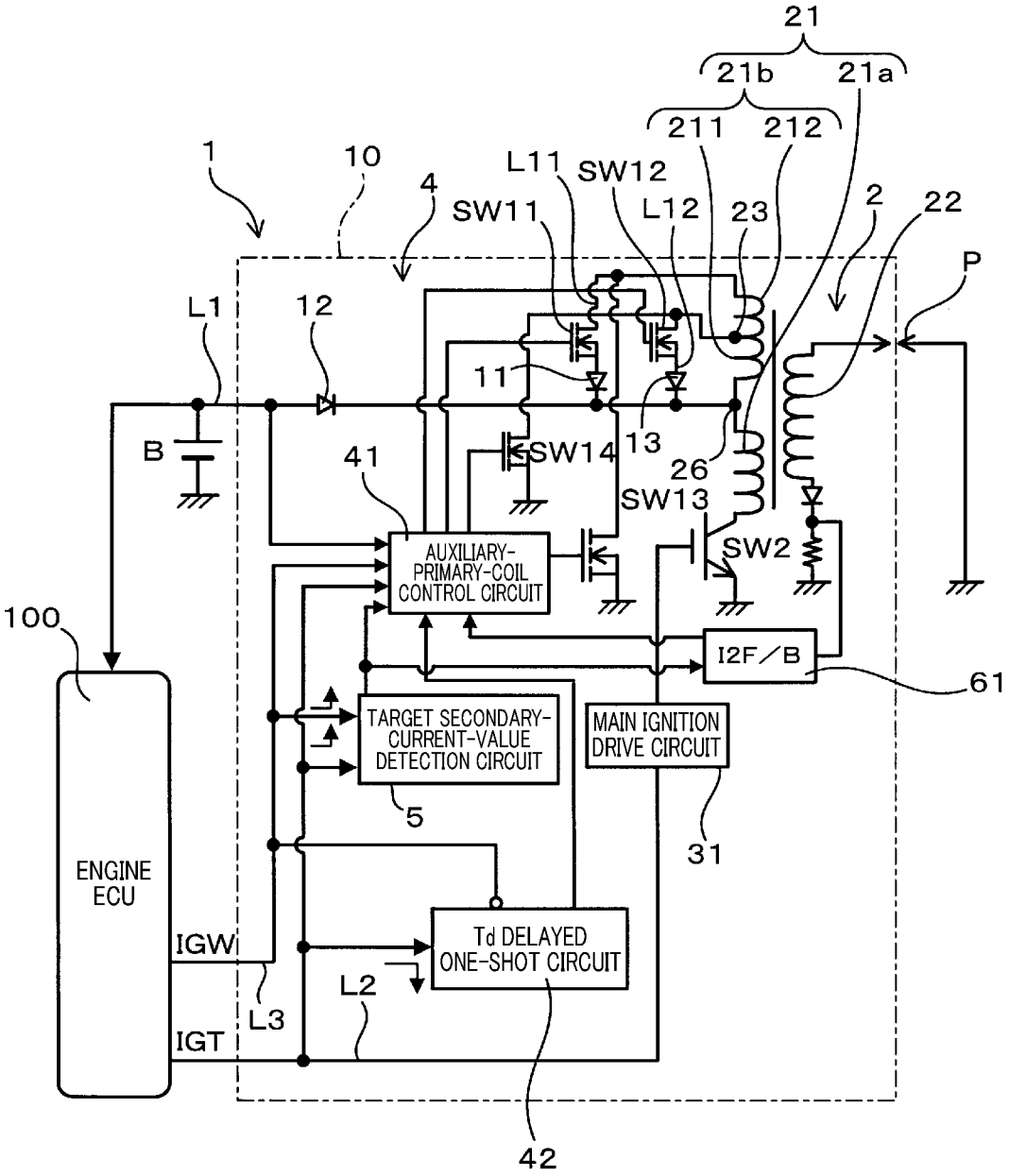
FIG. 12 is a circuit configuration diagram of an ignition control apparatus to which an ignition apparatus for an internal combustion engine according to a fifth embodiment is applied.

As shown in FIG. 12, according to the present embodiment as well, the intermediate tap 26 is provided between one end of the main primary coil 21*a* and one end of the auxiliary primary coil 21*b*. The power supply line L1 that leads to the direct-current power supply B is connected to the intermediate tap 26. The other end of the main primary coil 21*a* is grounded via the main ignition switch SW2. The other end of the auxiliary primary coil 21*b* is grounded via a first energization permission switch SW13. In addition, the intermediate tap 23 between the auxiliary-primary-coil portions 211 and 212 is grounded via a second energization permission switch SW14.

Furthermore, a first discharge continuation switch SW11 is provided in parallel with the first energization permission switch SW13, on the other end of the auxiliary primary coil 21*b*. The first discharge continuation switch SW11 is connected to the power supply line L1 via the second diode 11. The drain terminal of the first discharge continuation switch SW11 is connected to the auxiliary primary coil 21*b* and the source terminal is connected to the anode terminal of the second diode 11. The cathode terminal of the second diode 11 is connected to the power supply line L1.

In addition, the second discharge continuation switch SW12 is provided in parallel with the second energization permission switch SW14, in the intermediate tap 23 between the auxiliary-primary-coil portions 211 and 212. The second discharge continuation switch SW12 is connected to the power supply line L1 via a fourth diode 13. The drain terminal of the second discharge continuation switch SW12 is connected to the intermediate tap 23. The source terminal is connected to the anode terminal of the fourth diode 13. The cathode terminal of the fourth diode 13 is connected to the power supply line L1.

As a result, the energy supply operation can be performed using both of the auxiliary-primary-coil portions 211 and 212 by the first energization permission switch SW13 being switching-operated when the first discharge continuation switch SW11 is in the on-state. At this time, when the first energization permission switch SW13 is turned off, the recirculation path L11 that leads to the power supply line L1 is formed via the first discharge continuation switch SW11, and a return current flows. Therefore, sudden decrease in the secondary current I2 is suppressed.

Here, the second discharge continuation switch SW12 and the second energization permission switch SW14 are turned off during the main ignition operation and the energy supply operation.

Meanwhile, the energy supply operation can be performed using only the auxiliary-primary-coil portion 211 by the second energization permission switch SW14 being switching-operated when the second discharge continuation switch SW12 is in the on-state. At this time, when the second energization permission switch SW14 is turned off, a recirculation path L12 that leads to the power supply line L1 is formed via the second discharge continuation switch SW12, and a return current flows. Therefore, sudden decrease in the secondary current I2 can be suppressed.

Here, the first discharge continuation switch SW11 and the first energization permission switch SW13 are turned off during the main ignition operation and the energy supply operation.

According to the present embodiment as well, in a manner similar to that according to the above-described third embodiment, the main ignition signal IGT and the energy supply signal IGW that are outputted from the engine ECU 100 are inputted to the energy supply circuit unit 4 via the output signal lines L2 and L3. Therefore, as a result of switching of the auxiliary-primary-coil portions 211 and 212 being performed using the rising time difference T1 of these signals, effects similar to those according to the above-described fourth embodiment can be achieved.

Figure 13:
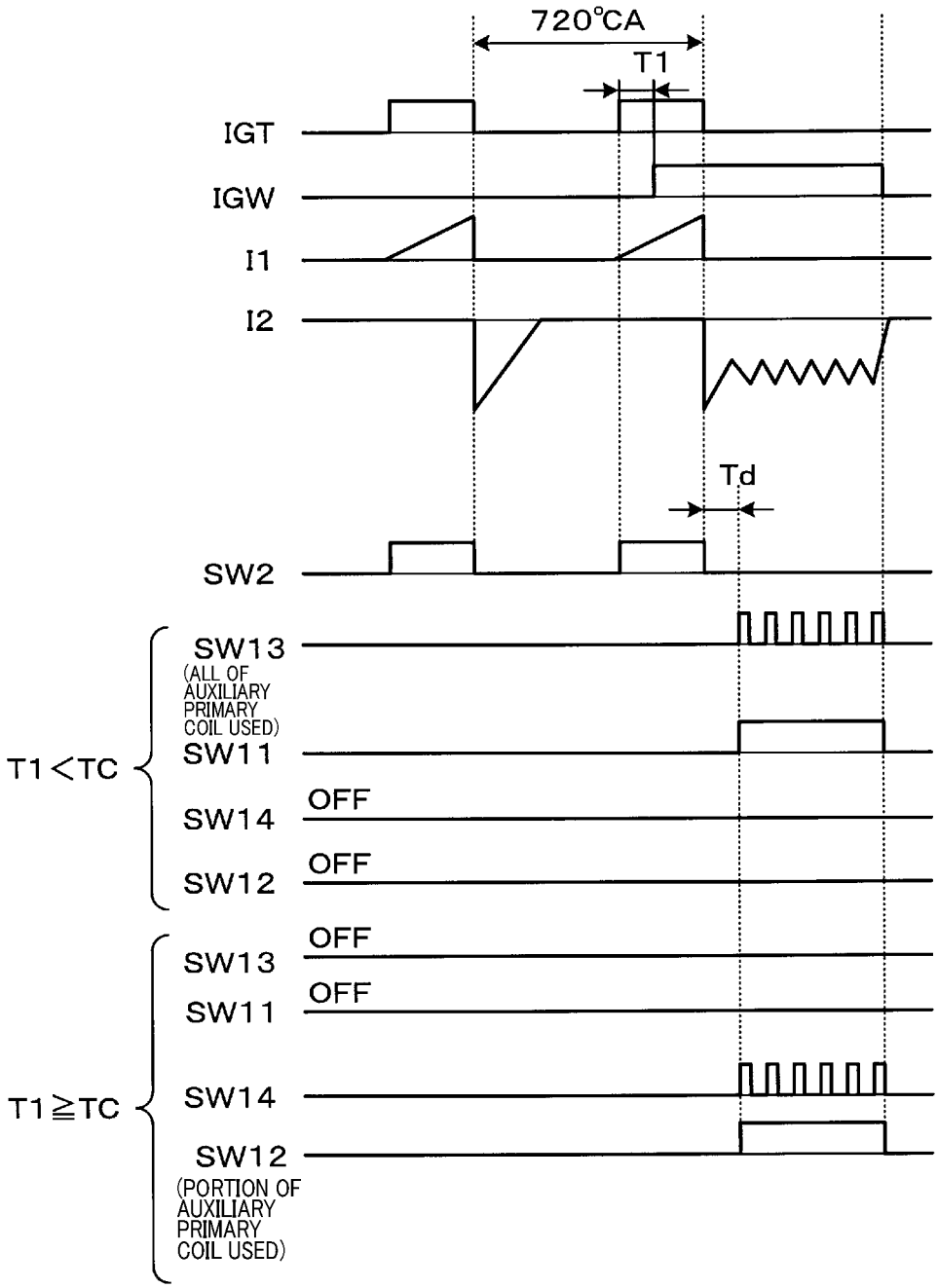
FIG. 13 is a time chart of transitions in a main ignition operation and an energy supply operation according to the fifth embodiment.

That is, as shown in FIG. 13, when the rising time difference T1 between the main ignition signal IGT and the energy supply signal IGW is less than the predetermined time threshold TC, a command signal is that for applying the power supply voltage to all of the auxiliary primary coil 21*b*. The energy supply operation is performed using both of the auxiliary-primary-coil portions 211 and 212.

Meanwhile, when the rising time difference I1 is equal to or greater than the predetermined time threshold TC, the command signal is that for applying the power supply voltage to a portion of the auxiliary primary coil 21*b*. The energy supply operation is performed using only the auxiliary-primary-coil portion 211.

In this manner, in the circuit configuration according to the present embodiment as well, switching of the auxiliary-primary-coil portions 211 and 212 can be performed using the rising time difference T1 between the main ignition signal IGT and the energy supply signal IGW. Effects similar to those according to the above-described fourth embodiment can be achieved.

Sixth Embodiment

An ignition apparatus for an internal combustion engine according to a sixth embodiment will be described with reference to FIG. 14 to FIG. 18.

According to the present embodiment, a basic configuration of the ignition control apparatus 1 that includes the ignition apparatus 10 and the engine ECU 100 is similar to that according to the above-described fourth embodiment. A circuit configuration for driving the auxiliary primary coil 21*b* in the ignition apparatus 10 differs. A configuration of the engine supply circuit unit 4 for switching the plurality of auxiliary-primary-coil portions 211 and 212 is similar to that according to the above-described fourth embodiment. Differences will mainly be described, below.

Figure 14:
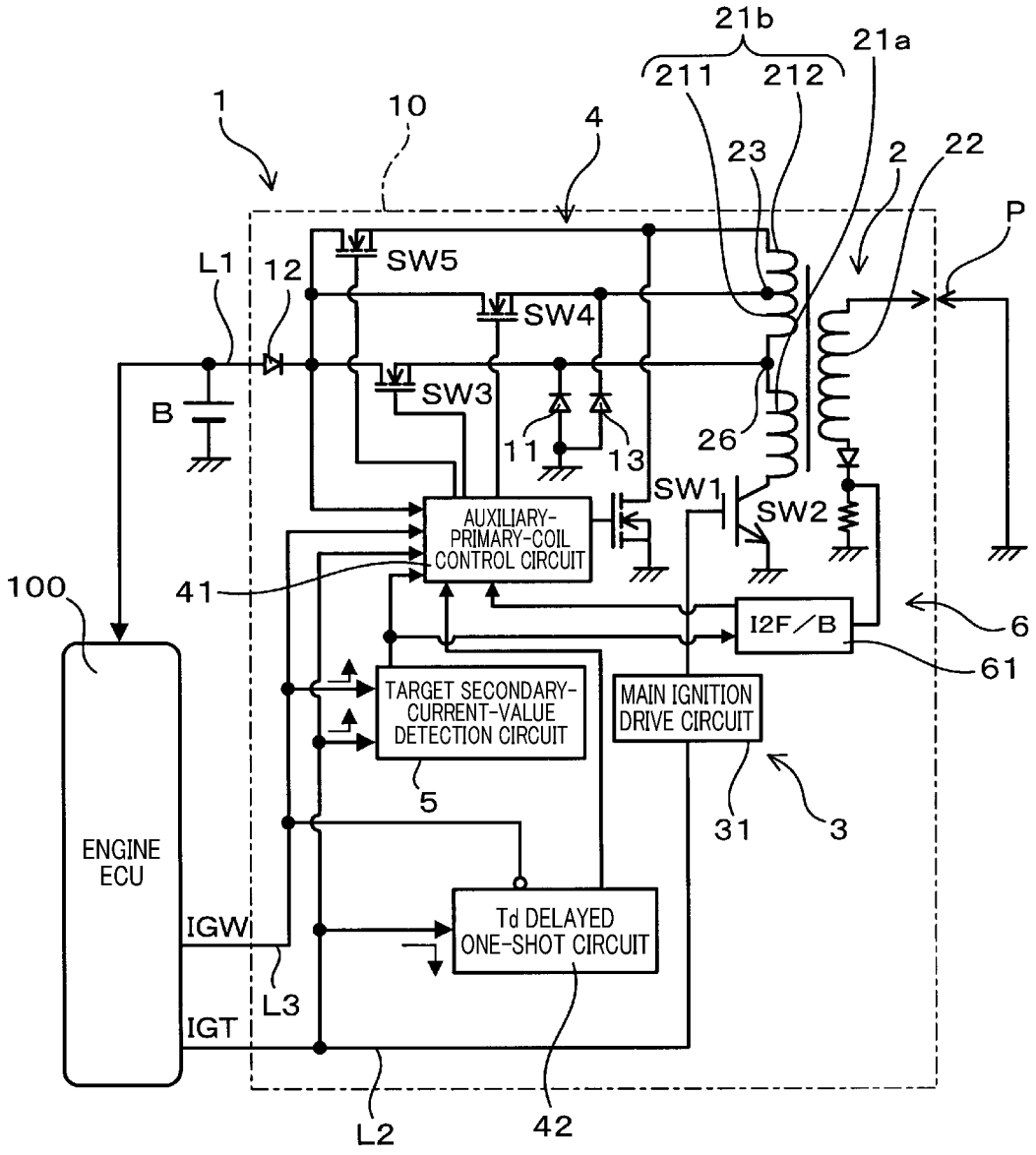
FIG. 14 is a circuit configuration diagram of an ignition control apparatus to which an ignition apparatus for an internal combustion engine according to a sixth embodiment is applied.

As shown in FIG. 14, according to the present embodiment as well, the intermediate tap 23 is provided between the auxiliary-primary-coil portions 211 and 212. The power supply line L1 that leads to the direct-current power supply B is connected to the intermediate tap 26 between one end of the main primary coil 21*a* and one end of the auxiliary primary coil 21*b*. The other end of the main primary coil 21*a* is grounded via the main ignition switch SW2. The other end of the auxiliary primary coil 21*b* is grounded via the discharge continuation switch SW1. The energization permission switch SW3 is provided between the intermediate tap 26 and the third diode 12. The cathode terminal of the second diode 11 is connected between the intermediate tap 26 and the energization permission switch SW3. The anode terminal of the second diode 11 is grounded.

In addition, the intermediate tap 23 between the auxiliary-primary-coil portions 211 and 212 is connected to the power supply line L1 via the changeover switch SW4. The changeover switch SW4 is provided between the intermediate tap 23 and the third diode 12. In addition, the cathode terminal of the fourth diode 13 is connected between the intermediate tap 23 and the changeover switch SW4. The anode terminal of the fourth diode 13 is grounded.

Furthermore, a switching element (referred to, hereafter, as an assisting switch) SW5 for assisting in the main ignition operation is provided between the other end on the auxiliary-primary-coil portion 212 side of the auxiliary primary coil 21*b* and the third diode 12, in parallel with the discharge continuation switch SW1. In addition, the cathode terminal of the second diode 11 is connected between the intermediate tap 26 and the energization permission switch SW3. The anode terminal of the second diode 11 is grounded.

As a result, during the main ignition operation, the main primary coil 21*a* can be energized and the auxiliary primary coil 21*b* can be energized by the main ignition switch SW2 being turned on and the assisting switch SW5 being turned on (for example, see FIG. 16), while the energization permission switch SW3 and the changeover switch SW4 remain turned off. That is, all of the primary coil 21 including the main primary coil 21*a* and the auxiliary primary coil 21*b* can be used in the main ignition operation. During the energy supply operation, after the main ignition switch SW2 and the assisting switch SW5 are turned off and the discharge continuation switch SW1 is turned on, the switching operation is performed using the energization permission switch SW3 or the changeover switch SW4.

In this configuration as well, in a manner similar to the above-described third embodiment, the main ignition signal IGT and the energy supply signal IGW that are outputted from the engine ECU 100 are inputted to the energy supply circuit unit 4 via the output signal line L2 and L3. Therefore, as a result of switching of the auxiliary primary coils 211 and 212 being performed using the rising time difference T1 of these signals, effects similar to those according to the above-described third embodiment can be achieved.

Figure 15:
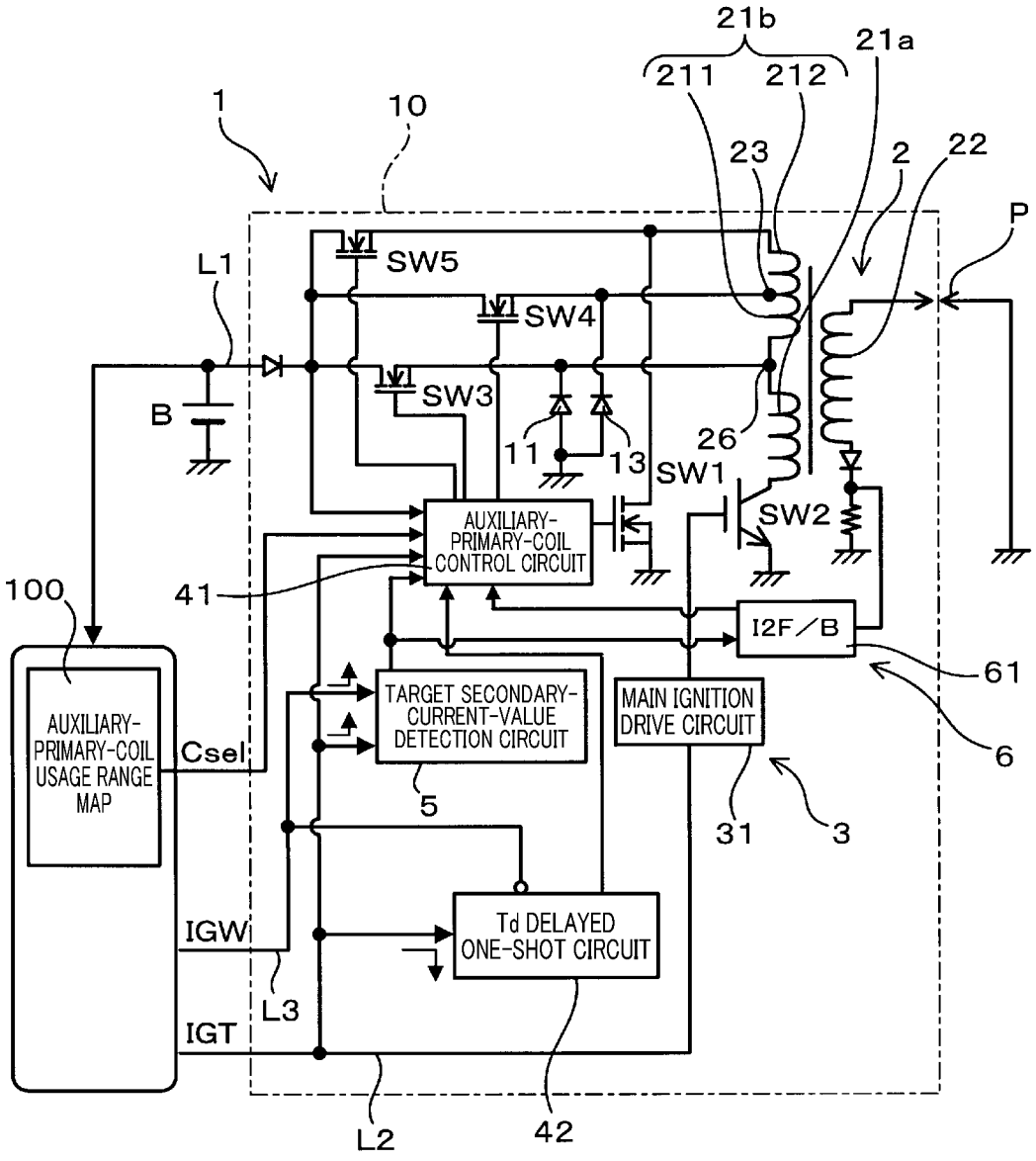
FIG. 15 is a circuit configuration diagram of an ignition control apparatus to which an ignition apparatus for an internal combustion engine of a variation example according to the sixth embodiment is applied.

Alternatively, as shown in a variation example according to the present embodiment in FIG. 15, a control signal Csel that controls switching of the auxiliary-primary-coil portions 211 and 212 may be generated in the engine ECU 100 and inputted to the auxiliary-primary-coil control circuit 41 via the signal output line L4. In this case, the energy supply signal IGW is not inputted to the auxiliary-primary-coil control circuit 41. A switching process can be performed using a logic level ("0" or "1") of the control signal Csel instead of the rising time difference T1.

Figure 16:
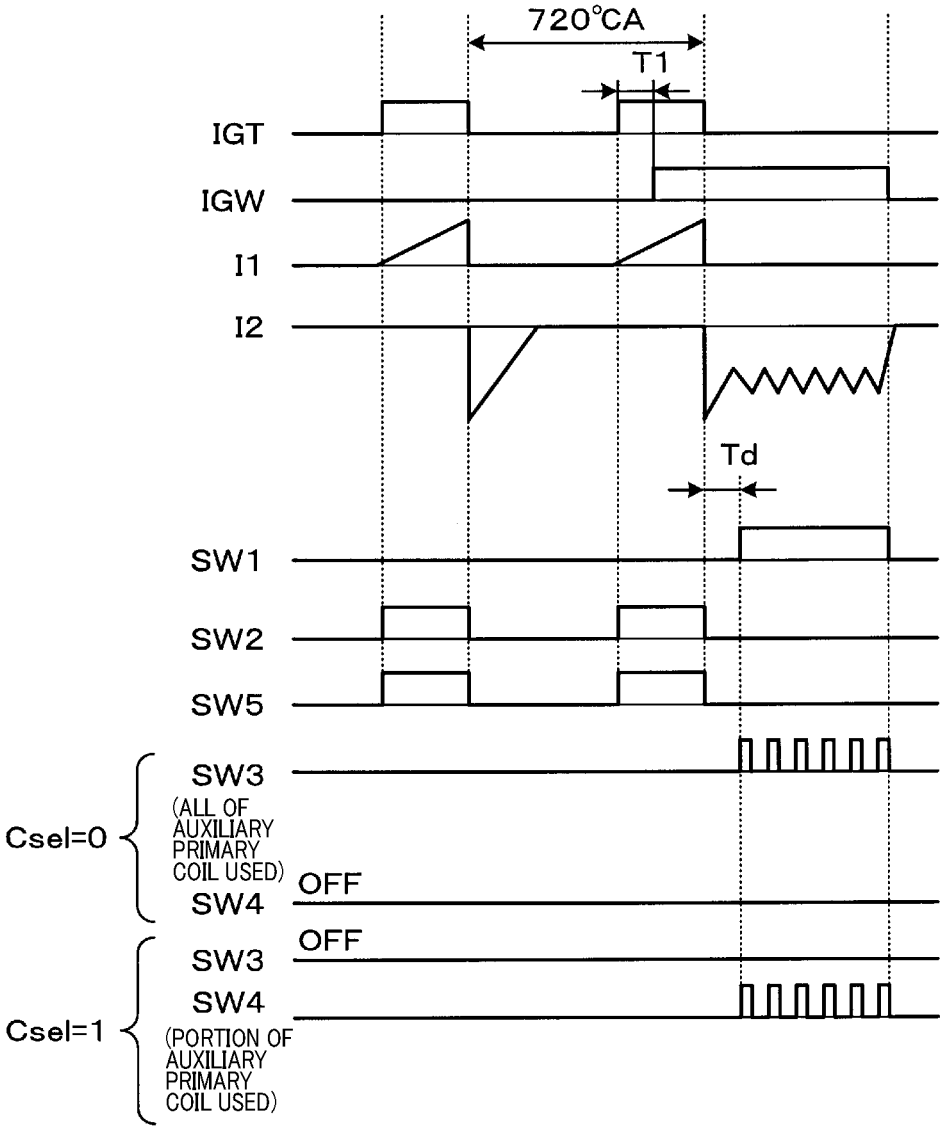
FIG. 16 is a time chart of transitions in a main ignition operation and an energy supply operation according to the sixth embodiment.

That is, as shown in FIG. 16, when the control signal Csel=0, the instruction is to apply the power supply voltage to all of the auxiliary primary coil 21*b*. The energy supply operation is performed using both of the auxiliary-primary-coil portions 211 and 212.

Meanwhile, when the control signal Csel=1, the instruction is to apply the power supply voltage to a portion of the auxiliary primary coil 21*b*. The energy supply operation is performed using only the auxiliary-primary-coil portion 211.

The switching process for the auxiliary primary coil 21*b* that is performed by the auxiliary-primary-coil control circuit 41 in this case will be described with reference to a flowchart shown in FIG. 17.

Figure 17:
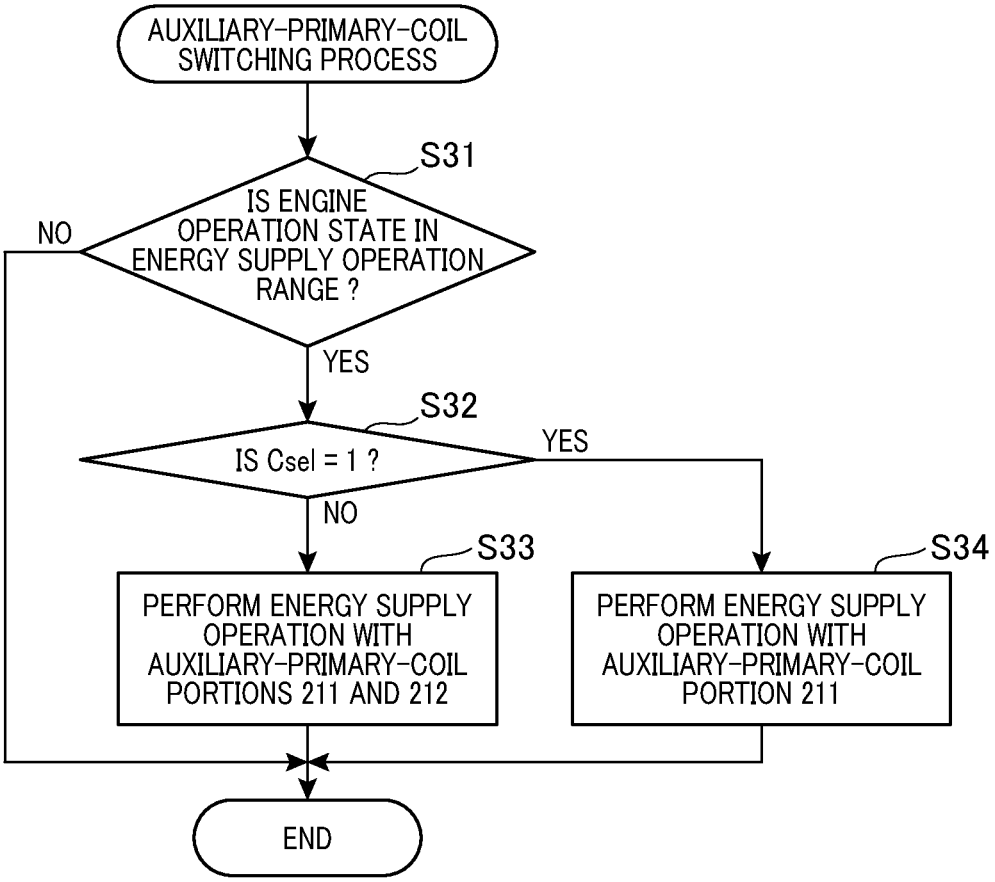
FIG. 17 is a flowchart of an auxiliary-primary-coil switching process performed by an auxiliary-primary-coil control circuit of the ignition apparatus according to the sixth embodiment.

In FIG. 17, when the switching process for the auxiliary primary coil 21*b* is started, first, at step S31, the auxiliary-primary-coil control circuit 41 determines whether the engine operation state is in the energy supply operation range that is set in advance, based on the energy supply signal IGW or the like. When a negative determination is made at step S31, the present process is temporarily ended.

When an affirmative determination is made at step S31, the auxiliary-primary-coil control circuit 41 proceeds to step S32. When a negative determination is made at step S32 (that is, Csel=0) at which whether the control signal Csel=1 is determined (that is, is Csel=1?), the auxiliary-primary-coil control circuit 41 proceeds to step S33. In this case, the instruction is to apply the power supply voltage to all of the auxiliary primary coil 21*b*. The energy supply operation is performed using both of the auxiliary-primary-coil portions 211 and 212. Subsequently, the present process is temporarily ended.

When an affirmative determination is made at step S32, the auxiliary-primary-coil control circuit 41 proceeds to step S34. In this case, the instruction is to apply the power supply voltage to a portion of the auxiliary primary coil 21*b*. The energy supply operation is performed using only the auxiliary-primary-coil portion 211. Subsequently, the present process is temporarily ended.

In this manner, in the engine ECU 100, the independent control signal Csel can be generated, and switching of the auxiliary primary coil 21*b* can be controlled. A circuit configuration for switching the auxiliary primary coil 21*b* inside the ignition apparatus 10 can be simplified. In addition, switching can be performed at high speed so as to match a signal level of the control signal Csel. Therefore, the Csel signal level can be changed even during the energy supply operation, and discharge current control that is further optimized for the combustion state of the engine can be performed. Here, when the control signal Csel is used, for example, the control signal Csel may be outputted based on an engine operation range, with reference to an auxiliary-primary-coil usage range map that is stored in the engine ECU 100 in advance.

Figure 18:
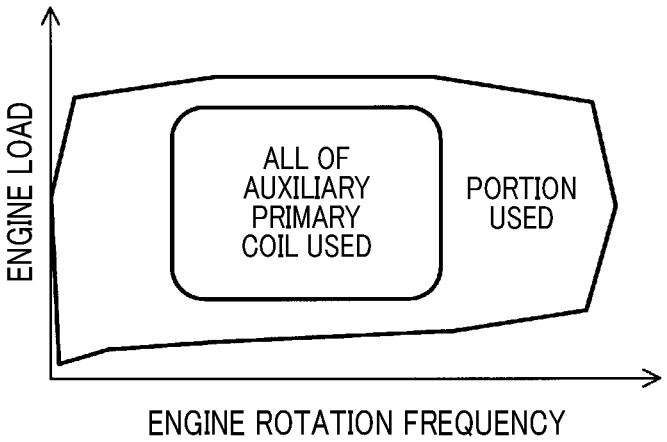
FIG. 18 is a diagram of a relationship between engine rotation frequency and engine load, and auxiliary-primary-coil usage range according to the sixth embodiment.

For example, as shown in an example in FIG. 18, switching of the auxiliary primary coil 21*b* can be performed using a relationship between the engine rotation frequency or the engine load, and the auxiliary-primary-coil usage range. In general, when the engine is in high-rotation or high-load, airflow speed inside a cylinder of the engine increases. The discharge spark elongates as a result of the airflow, thereby causing the discharge continuation voltage to increase. As a result, the voltage that rebounds to the auxiliary primary coil 21*b* increases and the power supply voltage at which energy can be supplied increases. In this case, the energy supply operation can be performed using a portion of the auxiliary primary coil 21*b*.

Therefore, as a result of a range in which the energy supply operation can be performed using all of the auxiliary primary coil 21*b* or a range in which the energy supply operation can be performed using a portion of the auxiliary primary coil 21*b* being set in advance based on such a relationship between the voltage of the auxiliary primary coil 21*b*, and the engine rotation frequency or the engine load, the energy supply operation that tracks the operation state of the engine can be implemented.

For example, a portion of the auxiliary primary coil 21*b* is used in a range outside (on a low-rotation-frequency side or a high-rotation-frequency side) of a rotation frequency range during ordinary operation in which all of the auxiliary primary coil 21*b* is used or a range outside (on a low-load side or a high-load side) a load range during ordinary operation in which all of the auxiliary primary coil 21*b* is used. In addition, for example, the energy supply operation may not be performed when the engine load is in an extremely low range. Movement between the ranges can be tracked at high speed.

The engine ECU 100 determines switching of the auxiliary primary coil 21*b* based on either of the engine rotation frequency and the engine load or both, based on detection signals from various sensors, and outputs the control signal Csel. The engine rotation frequency can be detected using an output from a rotation frequency sensor. The engine load can be detected using an output from a throttle opening sensor or an intake pressure sensor. Here, the relationship between the engine rotation frequency and the engine load, and the auxiliary-primary-coil usage range shown in FIG. 18 may be stored as the auxiliary-primary-coil usage range map in advance.

According to the present embodiment, as a result of switching of the auxiliary primary coil 21*b* being performed using the relationship between the engine rotation frequency range and the engine load range set in advance, reliable energy supply can be performed. In this manner, the energy supply operation can be performed over a wide operation range without measurement of the power supply voltage, the coil terminal voltage, and the like being performed.

Seventh Embodiment

Figure 19:
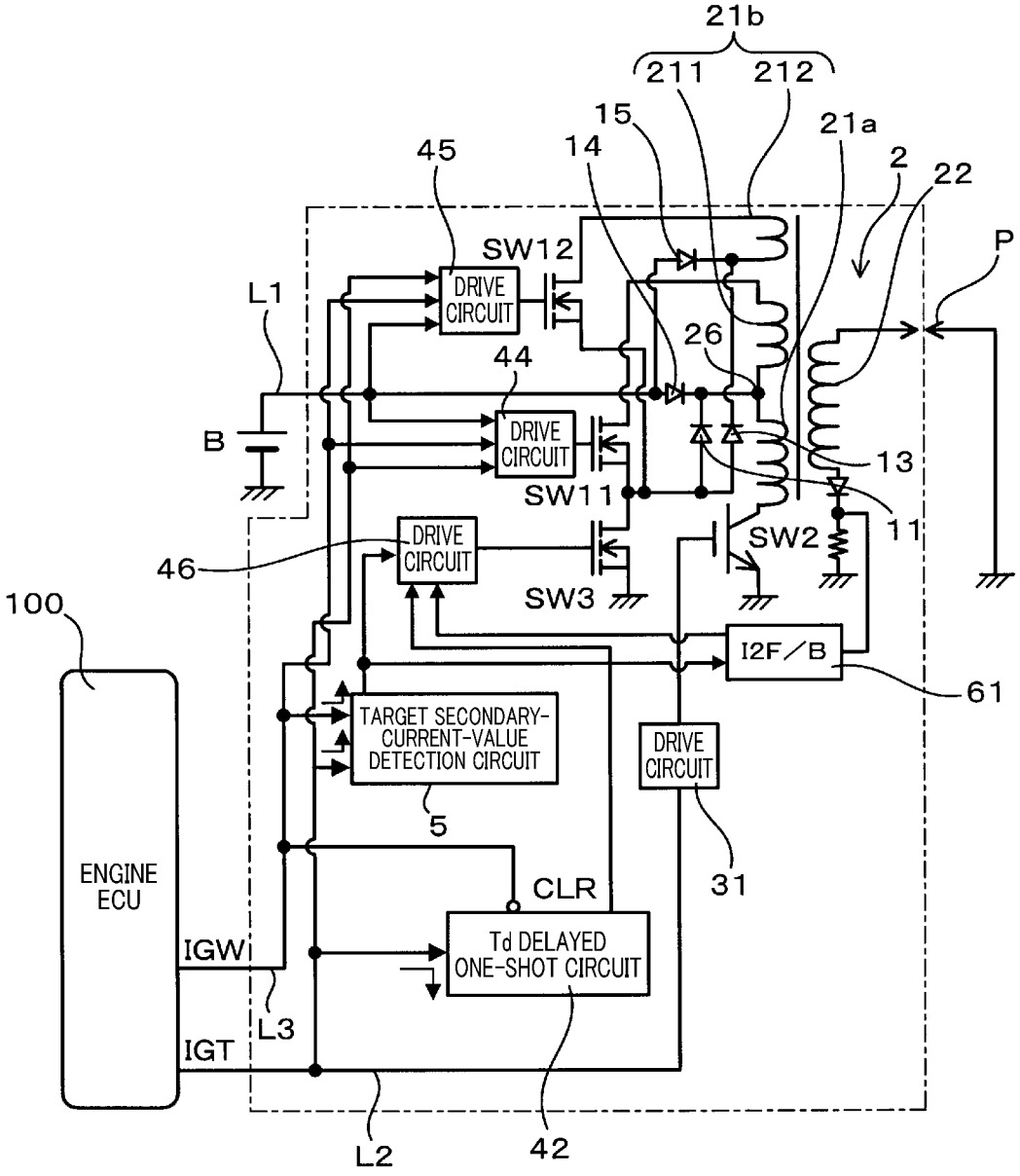
FIG. 19 is a circuit configuration diagram of an ignition control apparatus to which an ignition apparatus for an internal combustion engine according to a seventh embodiment is applied.

An ignition apparatus for an internal combustion engine according to a sixth embodiment will be described with reference to FIG. 19 and FIG. 20.

According to the present embodiment, a basic configuration of the ignition control apparatus 1 that includes the ignition apparatus 10 and the engine ECU 100 is similar to that according to the above-described fourth embodiment. As shown in FIG. 19, the plurality of auxiliary-primary-coil portions 211 and 212 of the ignition apparatus 10, a circuit configuration for driving the plurality of auxiliary-primary-coil portions 211 and 212, and a configuration of the energy supply circuit unit 4 for switching the plurality of auxiliary-primary-coil portions 211 and 212 differ. Differences will mainly be described, below.

According to the above-described embodiments, the configuration is such that the plurality of auxiliary-primary-coil portions 211 and 212 of the auxiliary primary coil 21*b* are divided using the intermediate tap 23. However, according to the present embodiment, separate auxiliary-primary-coil portions 211 and 212 that are magnetically coupled are connected in parallel to the power supply line L1. Of the auxiliary primary coil 21*b*, the auxiliary-primary-coil portion 211 is integrally provided with the main primary coil 21*a* via the intermediate tap 26 that is connected to the power supply line L1. For example, the numbers of turns of the auxiliary-primary-coil portions 211 and 212 are such that auxiliary-primary-coil portion 211>auxiliary-primary-coil portion 212.

At this time, a winding wire diameter of the plurality of auxiliary-primary-coil portions 211 and 212 may be such that the wire diameter becomes thicker as the coil increases in turn ratio. As the turn ratio increases, the number of turns decrease. Resistance value decreases. Therefore, the current during energy supply can be increased. Meanwhile, heat generation caused by the increase in current occurs. In this case, as a result of the wire diameter being made thicker, the resistance value can be further reduced, and heat generation can be suppressed.

In the auxiliary-primary-coil portion 211, one end is connected to the intermediate tap 26 and the other end is grounded via the first discharge continuation switch SW11 and the energization permission switch SW3.

In the auxiliary-primary-coil portion 212, one end is connected to the power supply line L1 and the other end is connected to a connection point between the first discharge continuation switch SW11 and the energization permission switch SW12, via the second discharge continuation switch SW12. A fifth diode 14 in which a direction towards the auxiliary-primary-coil portion 211 is a forward direction is provided between a connection point between one end of the auxiliary-primary-coil portion 212 and the power supply line L1 and one end of the auxiliary-primary-coil portion 211. A sixth diode 15 in which a direction towards the auxiliary-primary-coil portion 212 is a forward direction is provided between one end of the auxiliary-primary-coil portion 212 and the power supply line L1.

The first discharge continuation switch SW11 and the second discharge continuation switch SW 12 are respectively driven on/off by a first drive circuit 44 and a second drive circuit 45. In addition, the main ignition signal IGT and the energy supply signal IGW are inputted to the first drive circuit 44 and the second drive circuit 45. The auxiliary primary coil 21*b* is selectively used using the rising time difference TI1.

The one-shot pulse signal from the Td delayed one-shot circuit 42 is inputted to a third drive circuit 46. An AND operation of the one shot-pulse signal and the output from the secondary-current feedback circuit 61 is determined, and the energization permission switch SW3 is turned on/off. Control is thereby performed so that the discharge current becomes the target secondary current.

The cathode terminal of the second diode 11 is connected between one end of the auxiliary-primary-coil portion 211 and the fifth diode 14. The anode terminal of the second diode 11 is connected to the connection point between the first discharge continuation switch SW11 and the energization permission switch SW3.

In addition, the cathode terminal of the fourth diode 13 is connected between one end of the auxiliary-primary-coil portion 212 and the sixth diode 15. The anode terminal of the fourth diode 13 is connected to the connection point between the first discharge continuation switch SW11 and the energization permission switch SW3.

In this manner, the energization permission switch SW3 is driven on/off by the third drive circuit 46 based on the detection signal from the target secondary-current-value detection circuit 5 and the feedback signal SFB from the secondary-current feedback circuit 61.

As a result, either of the auxiliary-primary-coil portion 211 and the auxiliary-primary-coil portion 212 can be driven by the energization permission switch SW3 being driven on/off when the first discharge continuation switch SW11 or the second discharge continuation switch SW12 is in the on-state.

Figure 20:
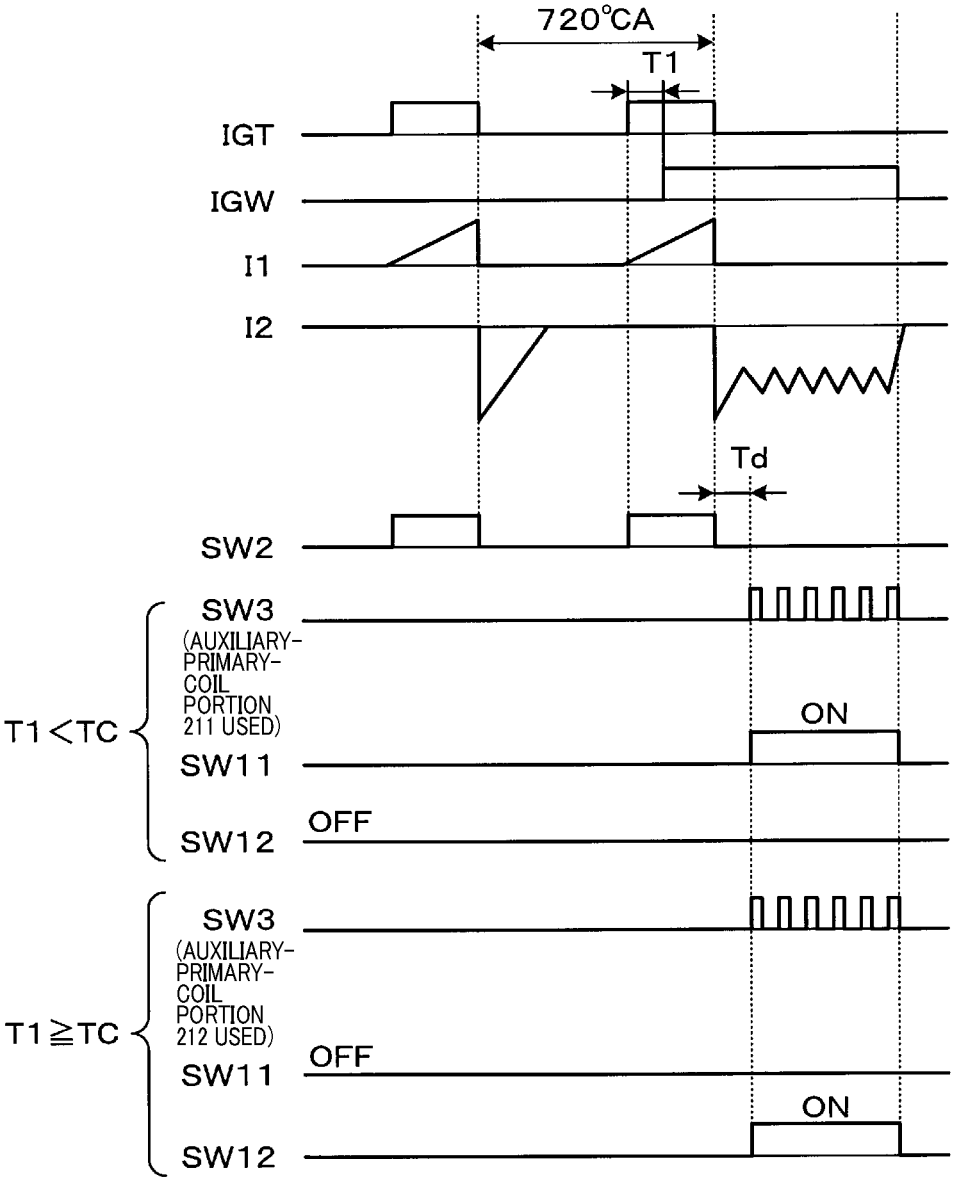
FIG. 20 is a time chart of transitions in a main ignition operation and an energy supply operation according to the seventh embodiment.

As shown in FIG. 20, specifically, switching of the auxiliary-primary-coil portions 211 and 212 is performed using the rising time difference T1 between the main ignition signal IGT and the energy supply signal IGW. When the rising time difference T1<time threshold TC, the auxiliary-primary-coil portion 211 that has a greater number of turns (that is, a smaller turn ratio) is used.

Then, as a result of a switching signal from the third drive circuit 46, the first discharge continuation switch SW11 is turned on by the first drive circuit 44. In addition, the energization permission switch SW3 is switching-operated by the third drive circuit 46. As a result, the energy supply operation can be performed using the auxiliary-primary-coil portion 211.

Meanwhile, when the rising time difference T1≥time threshold TC, the auxiliary-primary-coil portion 212 that has a smaller number of turns (that is, a greater turn ratio) is used. Then, as a result of the switching signal from the third drive circuit 46, the second discharge continuation switch SW12 is turned on by the second drive circuit 45. In addition, the energization permission switch SW3 is switching-operated by the third drive circuit 46. As a result, the energy supply operation can be performed using the auxiliary-primary-coil portion 212.

Here, a condition regarding the power supply voltage described according to the first embodiment can be added to the switching conditions for the auxiliary primary coil 21*b*. When the power supply voltage is low, the auxiliary primary coil portion 212 that has a smaller number of turns may be used regardless of a switching instruction from the engine ECU 100. The energy supply operation may thereby be reliably performed.

In addition, when the energization permission switch SW3 is off, a return current flows via the first discharge continuation switch SW11 and the second diode 11 or the second discharge continuation switch 12 and the fourth diode 13. Therefore, sudden decrease in the secondary current I2 can be suppressed.

As according to the present embodiment, the plurality of auxiliary-primary-coil portions 211 and 212 may be provided in parallel, and switching operation may be performed in the single energization permission switch SW3. Effects similar to those according to the above-described embodiment can be achieved. In addition, as a result of the plurality of auxiliary-primary-coil portions 211 and 212 being separately provided, heat capacity increases. Temperature increase in the overall ignition coil can be suppressed.

Eighth Embodiment

An ignition apparatus for an internal combustion engine according to an eighth embodiment will be described with reference to FIG. 21 to FIG. 24.

According to the present embodiment, a basic configuration of the ignition control apparatus 1 that includes the ignition apparatus 10 and the engine ECU 100 can be similar to those according to the above-described embodiments. The present embodiment differs in that the plurality of auxiliary-primary-coil portions 211 and 212 are switched using a temperature of the ignition coil 2.

Figure 21:
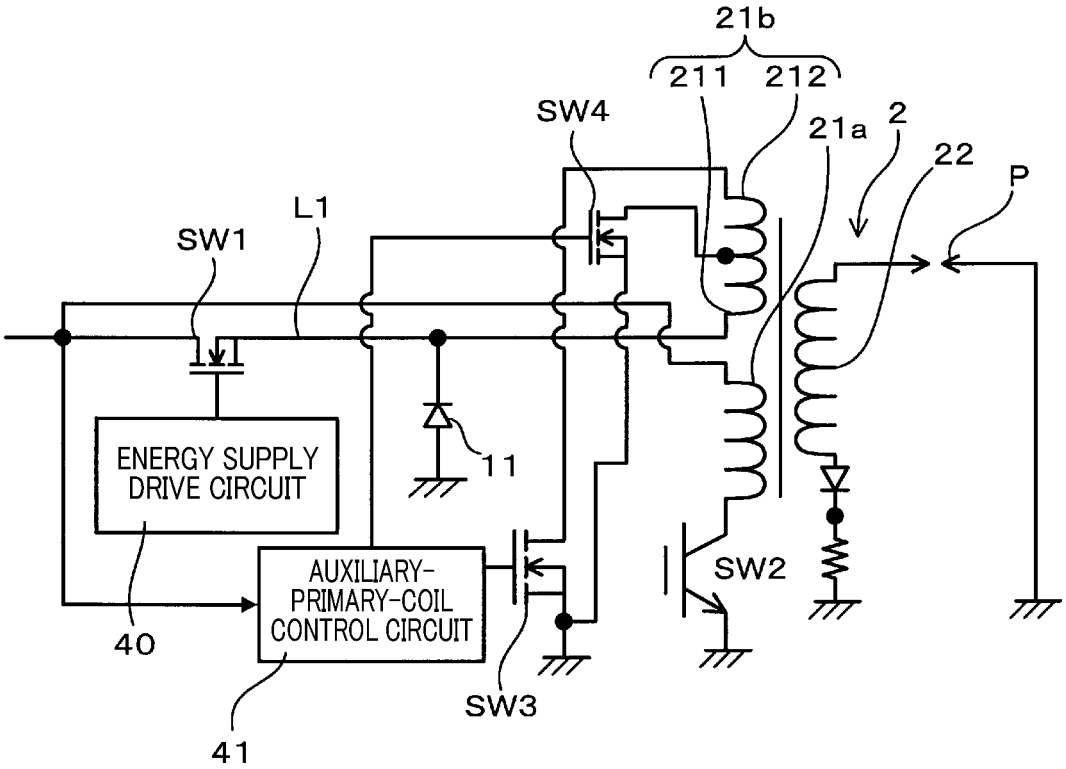
FIG. 21 is a circuit configuration diagram of an ignition apparatus for an internal combustion engine according to an eighth embodiment.

For example, as shown in FIG. 21, in the case of the circuit configuration that includes the ignition coil 2 similar to that according to the above-described first embodiment, in addition to switching of the auxiliary primary coil 21*b* being performed based on the detection result of the power supply voltage and the like, the temperature of the auxiliary primary coil 21*b* may be estimated, and switching of the auxiliary primary coil 21*b* may be performed based on the estimation result.

In addition, according to the above-described embodiments, a portion or all of the plurality of auxiliary-primary-coil portions 211 and 212 is selected based on the detection result of the power supply voltage and the like. However, the energy supply operation may be started using a portion of the auxiliary-primary-coil portions 211 and 212 selected in advance. Subsequently, the temperature of the auxiliary primary coil 21*b* may be estimated, and switching of the auxiliary primary coil 21*b* may be determined.

Figure 22:
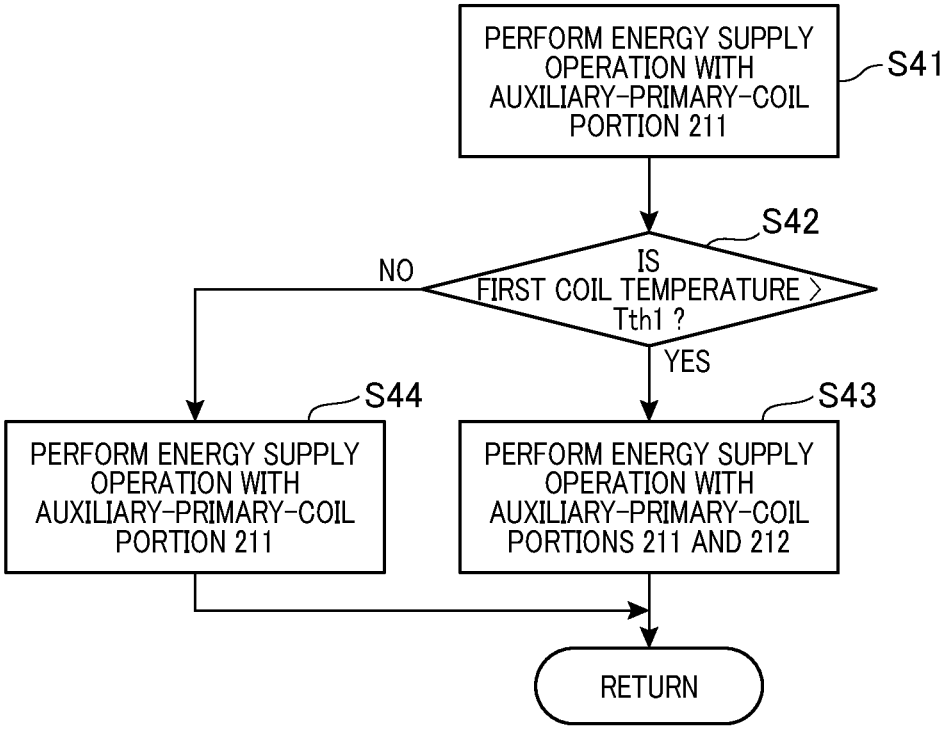
FIG. 22 is a flowchart of an auxiliary-primary-coil switching process performed by an auxiliary-primary-coil control circuit of the ignition apparatus according to the eighth embodiment.

In this case, as shown in FIG. 22, first, at step S41, the auxiliary-primary-coil control circuit 41 selects the auxiliary-primary-coil portion 211 that is a portion of the auxiliary primary coil 21*b* and performs the energy supply operation.

As described above, when the plurality of auxiliary-primary-coil portions 211 and 212 are used so as to be switched, energy supply can be performed even when the power supply voltage is low, as the turn ratio increases. Therefore, as a result of only a portion of the auxiliary primary coil 21*b* being energized, energy supply can be reliably started. However, when an amount of energization increases, coil resistance increases as a result of heat generation. Energy supply efficiency decreases instead.

Therefore, at subsequent step S42, the auxiliary-primary-coil control circuit 41 detects a temperature (referred to, hereafter, as a first coil temperature) of the auxiliary-primary-coil portion 211, and determines whether the detected first coil temperature is higher than a temperature threshold Tth1 (that is, is first coil temperature >Tth1?).

For example, a current sensor can be provided on a current path of the auxiliary-primary-coil portion 211 and a current can be detected. The first coil temperature can be estimated through use of a correlation being present between a slope of changes in the current flowing through the auxiliary-primary-coil portion 211 and the temperature of the auxiliary-primary-coil portion 211.

For example, as the current sensor, a sense MOSFET in which a current sense terminal is provided can be used as the discharge continuation switch SW1. Alternatively, the first coil temperature may be estimated from a history of the energization state of the auxiliary-primary-coil portion 211.

When an affirmative determination is made at step S42, the auxiliary-primary-coil control circuit 41 proceeds to step S43 and performs the energy supply operation by both of the plurality of auxiliary-primary-coil portions 211 and 212. That is, the energy supply operation is switched to that using all of the auxiliary primary coil 21*b*.

As a result, heat generation is no longer concentrated in only the auxiliary-primary-coil portion 211. As a result of the overall auxiliary primary coil 21*b* being energized, heat generation can be dispersed. Temperature increase in the auxiliary-primary-coil portion 211 can be suppressed.

Subsequently, the present process is temporarily ended.

When a negative determination is made at step S42, the auxiliary-primary-coil control circuit 41 proceeds to step S44 and continues the energy supply operation by only the auxiliary-primary-coil portion 211. Subsequently, the present process is temporarily ended.

Figure 23:
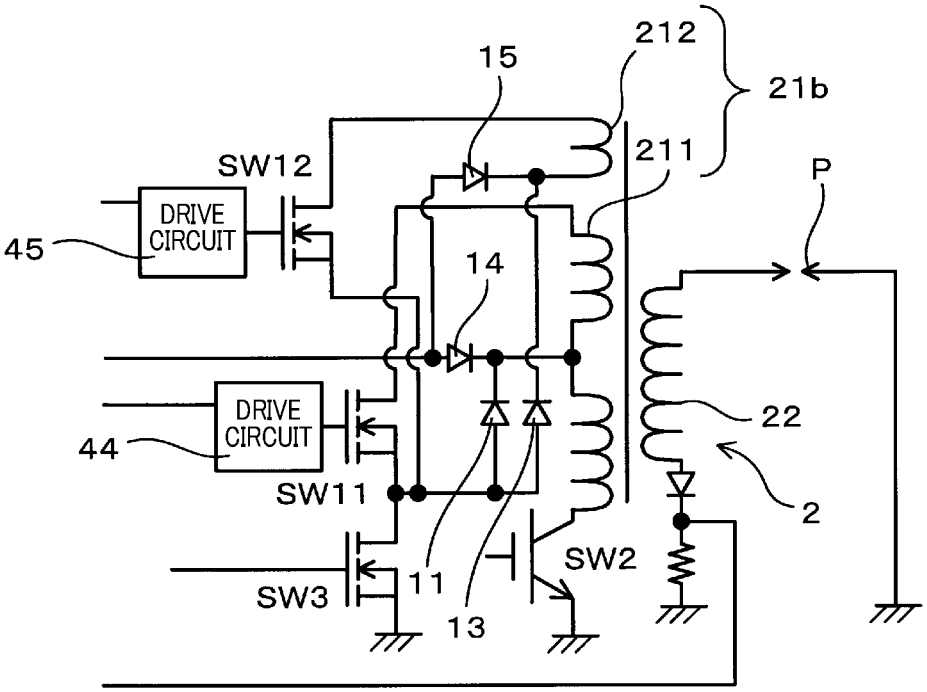
FIG. 23 is a circuit configuration diagram of an ignition apparatus for an internal combustion engine of a variation example according to the eighth embodiment.

In addition, as another example, as shown in FIG. 23, even in the case of the circuit configuration that includes the ignition coil 2 similar to that according to the above-described seventh embodiment, switching of the auxiliary primary coil 21*b* can be similarly performed based on the estimation result of the temperature of the auxiliary primary coil 21*b*.

Figure 24:
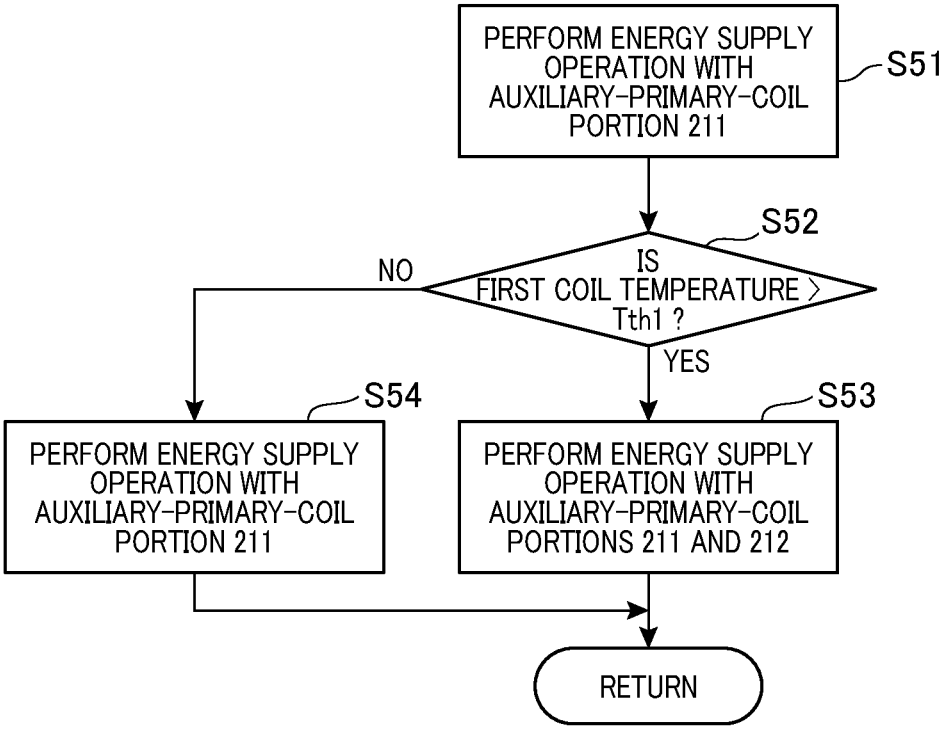
FIG. 24 is a flowchart of an auxiliary-primary-coil switching process performed by an auxiliary-primary-coil control circuit of the ignition apparatus in the variation example according to the eighth embodiment.
Figure 25:
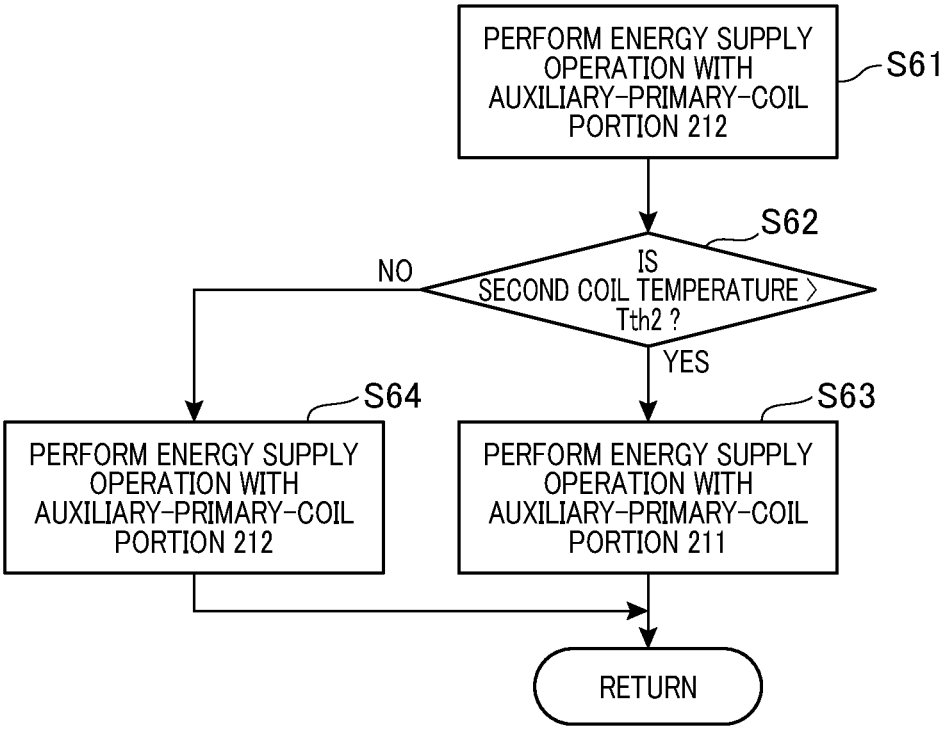
FIG. 25 is a flowchart of the auxiliary-primary-coil switching process performed by the auxiliary-primary-coil control circuit of the ignition apparatus in the variation example according to the eighth embodiment.

In this case, as shown in flowcharts in FIG. 24 and FIG. 25, either of the plurality of auxiliary-primary-coil portions 211 and 212 that are arranged in parallel may be selectively energized and, based on the estimation result of the temperature thereof, switching to the other of the auxiliary-primary-coil portions 211 and 212 may be performed.

In FIG. 24, first, at step S51, the auxiliary-primary-coil control circuit 41 selects the auxiliary-primary-coil portion 211 that is a portion of the auxiliary primary coil 21*b*, and performs the energy supply operation. Next, at step S52, the auxiliary-primary-coil control circuit 41 detects the temperature of the auxiliary-primary-coil portion 211 (that is, the first coil temperature), and determines whether the detected first coil temperature is higher than the temperature threshold Tth1 (that is, is first coil temperature >Tth1?).

When an affirmative determination is made at step S52, the auxiliary-primary-coil control circuit 41 proceeds to step S53. The auxiliary-primary-coil control circuit 41 selects the auxiliary-primary-coil portion 212 that is another portion of the auxiliary-primary-coil portion 21*b*, and performs the energy supply operation. Subsequently, the present process is temporarily ended.

When a negative determination is made at step S52, the auxiliary-primary-coil control circuit 41 proceeds to step S54 and continues the energy supply operation by the auxiliary-primary-coil portion 211. Subsequently, the present process is temporarily ended.

In cases such as this in which the plurality of auxiliary-primary-coil portions 211 and 212 of the auxiliary primary coil 21*b* are separately provided and mounting positions differ, as a result of switching from either of the auxiliary-primary-coil portions 211 and 212 to the other being performed, heat generation is dispersed. The effect of suppressing temperature increase is high.

When switching to the auxiliary-primary-coil portion 212 is performed at step S53 in FIG. 24, next, a similar process can be performed in the flowchart in FIG. 25.

In this case, first, at step S61, the auxiliary-primary-coil control circuit 41 performs the energy supply operation by the auxiliary-primary-coil portion 212. Next, at step S62, the auxiliary-primary-coil control circuit 41 detects a temperature (hereafter, a second coil temperature) of the auxiliary-primary-coil portion 212, and determines whether the detected second coil temperature is higher than a temperature threshold Tth2 (that is, is second coil temperature >Tth2?).

When an affirmative determination is made at step S62, the auxiliary-primary-coil control circuit 41 proceeds to step S63. The auxiliary-primary-coil control circuit 41 selects the auxiliary-primary-coil portion 211 that is another portion of the auxiliary primary coil 21*b*, and performs the energy supply operation. Subsequently, the present process is temporarily ended.

When a negative determination is made at step S62, the auxiliary-primary-coil control circuit 41 proceeds to step S64 and continues the energy supply operation by the auxiliary-primary-coil portion 212. Subsequently, the present process is temporarily ended.

As a result of a process such as this being repeated, the energy supply operation can be continued more easily than when the same auxiliary-primary-coil portions 211 and 212 are continuously used, while temperature increase in the overall auxiliary primary coil 21*b* is suppressed.

Ninth Embodiment

An ignition apparatus for an internal combustion engine according to a ninth embodiment will be described with reference to FIG. 26 and FIG. 27.

According to the present embodiment, a basic configuration and a basic operation of the ignition control apparatus 1 that includes the ignition apparatus 10 and the engine ECU 100 are similar to those according to the above-described third embodiment. Drawings thereof are omitted.

According to the present embodiment, a specific example of a case in which, in the configuration in which the plurality of auxiliary-primary-coil portions 211 and 212 are switched using the phase difference between the main ignition signal IGT and the energy supply signal IGW, a plurality of target secondary-current values I2tgt can be further specified based on the phase difference between the main ignition signal IGT and the energy supply signal IGW.

As shown in FIG. 8, described above, these signals are set so that the energy supply signal IGW has the rising time difference T1 after the rising of the main ignition signal IGT. Switching of the auxiliary primary coil 21*b* can be performed based on a comparison of the rising time difference T1 to the time threshold TC that is set in advance.

As a result of the rising time difference T1 being further compared to a threshold TI1 and a threshold TI2 that are values less than the time threshold TC (that is, TI1<TI2<TC), or compared to a threshold Tb1 and a threshold Tb2 that are values equal to or greater than the time threshold TC (that is, TC<Tb1<Tb2), the target secondary-current value I2tgt can be set.

Specifically, as shown in Table 2, below, when the rising time difference T1 is less than the time threshold TC, all of the auxiliary primary coil 21*b* is used. That is, when the discharge continuation switch SW is in the switching operation state, as a result of the energization permission switch SW3 being on-operated, the energy supply operation using all of the auxiliary primary coil 21*b* is performed. When the rising time difference T1 is equal to or greater than the time threshold TC, as a result of the energization permission switch SW3 being turned off and the changeover switch SW4 being on-operated, the energy supply operation using a portion of the auxiliary primary coil 21*b* is performed.

TABLE 2

| | | 12tgt (T1 < TC) | | |
|---|---|---|---|---|
| Rising time difference T1 | Auxiliary primary coil used | Less than TI1 | Greater than TI1 and less than TI2 | Equal to or greater than TI2 |
| Less than TC | Auxiliary-primary-coil portions 211 and 212 | 120 mA | 90 mA | 60 mA |
| | | 12tgt (T1 ≥ TC) | | |
| Rising time difference T1 | Auxiliary primary coil used | Less than Tb1 | Greater than Tb1 and less than Tb2 | Equal to or greater than Tb2 |
| Equal to or greater than TC | Only auxiliary-primary-coil portion 211 | 120 mA | 90 mA | 60 mA |

According to the present embodiment, the rising time difference T1 is further divided into three stages that are: less than the time threshold TC and less than the threshold TI1; equal to or greater than the threshold TI1 and less than the threshold TI2; and equal to or greater than the threshold TI2. For example, the respective target secondary-current values I2tgt are set to 120 mA, 90 mA, and 60 mA. In a similar manner, the rising time difference T1 can be divided into three stages that are: equal to or greater than the time threshold TC and less than the threshold Tb1; equal to or greater than the threshold Tb1 and less than the threshold Tb2; and equal to or greater than the threshold Tb2. For example, the respective target secondary-current values I2tgt can be set to 120 mA, 90 mA, and 60 mA. A relationship among these thresholds can be set in a following manner, for example, such that a signal width of the main ignition signal IGT ranges between a maximum value and a minimum value.

$$TI1\ (0.6\ \text{ms}) < TI2\ (0.8\ \text{ms}) < TC\ (1\ \text{ms}) \leq Tb1\ (1.2\ \text{ms}) < Tb2\ (1.4\ \text{ms})$$

A switching process for the auxiliary primary coil 21*b* that is performed by the auxiliary-primary-coil control circuit 41 in this case will be described with reference to a flowchart shown in FIG. 26.

Figure 26:
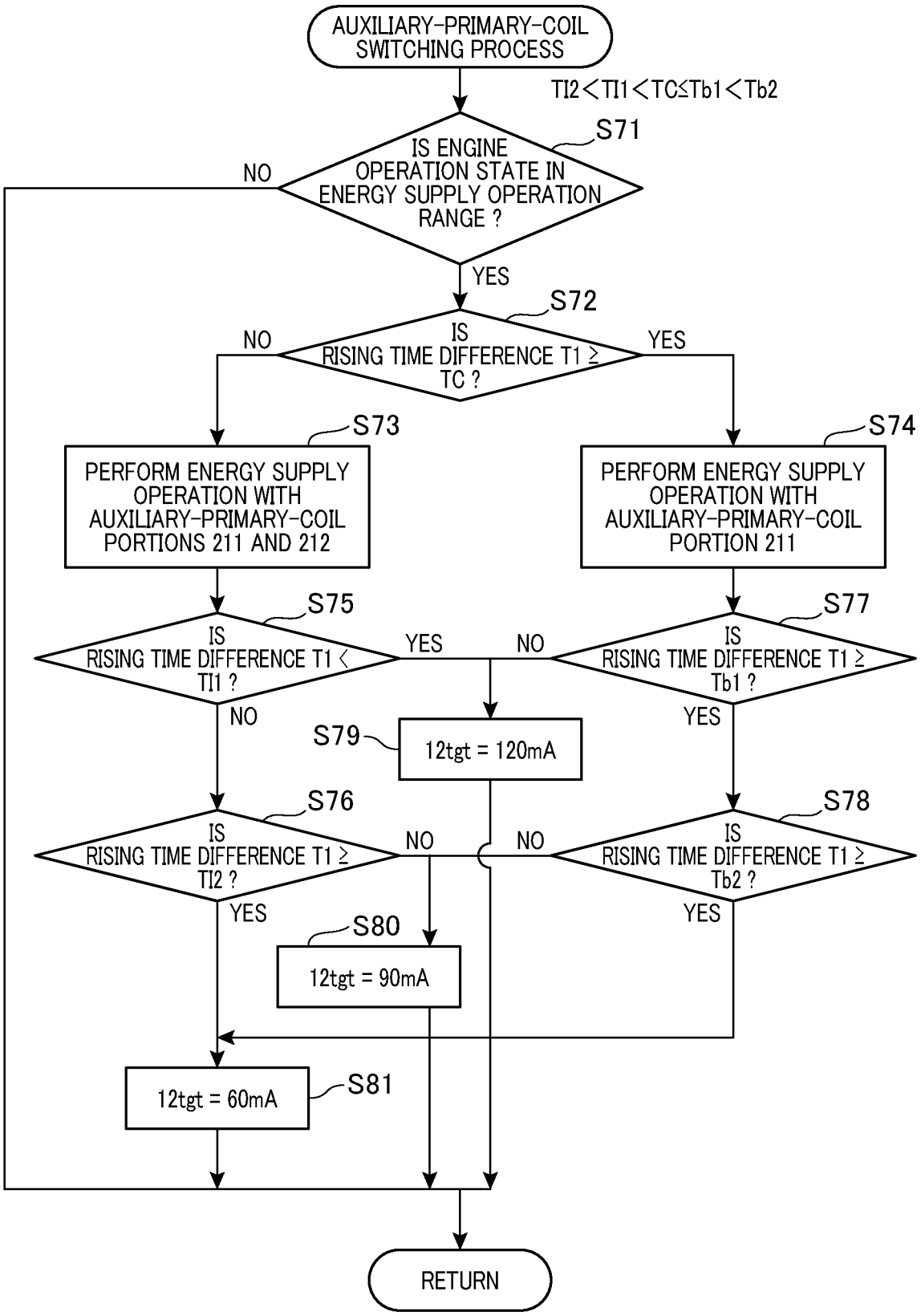
FIG. 26 is a flowchart of an auxiliary-primary-coil switching process performed by an auxiliary-primary-coil control circuit of the ignition apparatus according to the ninth embodiment.
Figure 27:
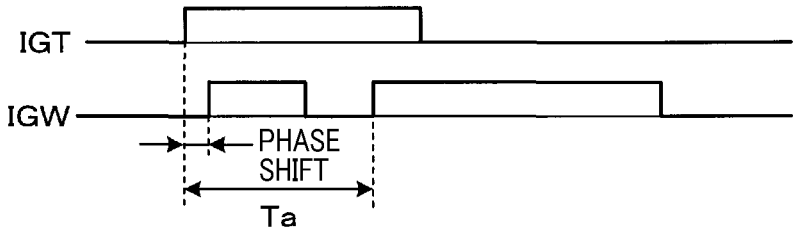
FIG. 27 is a waveform diagram of a main ignition signal and an energy supply signal inputted to an ignition apparatus in a variation example according to the ninth embodiment.

In FIG. 26, when the switching process for the auxiliary primary coil 21*b* is started, first, at step S71, the auxiliary-primary-coil control circuit 41 determines whether the engine operation state is in the energy supply operation range that is set in advance, based on the presence/absence of the energy supply signal IGW or the like. When a negative determination is made at step S71, the present process is temporarily ended.

When an affirmative determination is made at step S71, the auxiliary-primary-coil control circuit 41 proceeds to step S72. The auxiliary-primary-coil control circuit 41 calculates the rising time difference T1 between the main ignition signal IGT and the energy supply signal IGW, and determines whether the rising time difference T1 is equal to or greater than the predetermined time threshold TC (that is, is rising time difference T1≥TC?).

When a negative determination is made at step S72 (that is, rising time difference T1<TC), the auxiliary-primary-coil control circuit 41 proceeds to step S73. In this case, the power supply voltage can be applied to all of the auxiliary primary coil 21*b*. The energy supply operation using both of the auxiliary-primary-coil portions 211 and 212 is performed (for example, see FIG. 8). Subsequently, the target secondary-current value I2tgt is set at steps S75 and S76.

When an affirmative determination is made at step S72, the auxiliary-primary-coil control circuit 41 proceeds to step S74. In this case, the instruction is to apply the power supply voltage to a portion of the auxiliary primary coil 21*b*. The energy supply operation is performed using only the auxiliary-primary-coil portion 211 (for example, see FIG. 8). Subsequently, the target secondary-current value I2tgt is set at steps S75 and S76.

At step S75, the auxiliary-primary-coil control circuit 41 determines whether the rising time difference T1 is less than the threshold TI1 (that is, is rising time difference T1<TI1?). When an affirmative determination is made at step S75, the auxiliary-primary-coil control circuit 41 proceeds to step S79 and sets the target secondary-current value I2tgt to 120 mA. When a negative determination is made at step S75 (that is, rising time difference T1≥TI1), the auxiliary-primary-coil control circuit 41 proceeds to step S76 and further determines whether the rising time difference T1 is equal to or greater than the threshold TI2 (that is, is rising time difference T1≥TI2?).

When a negative determination is made at step S76 (that is, TI1≤rising time difference T1<TI2), the auxiliary-primary-coil control circuit 41 proceeds to step S80 and sets the target secondary-current value I2tgt to 90 mA. When an affirmative determination is made at step S76, the auxiliary-primary-coil control circuit 41 proceeds to step S81 and sets the target secondary-current value I2tgt to 60 mA.

Meanwhile, at step S77, the auxiliary-primary-coil control circuit 41 determines whether the rising time difference T1 is equal to or greater than the threshold Tb1 (that is, is rising time difference T1≥Tb1?). When an affirmative determination is made at step S77, the auxiliary-primary-coil control circuit 41 proceeds to step S79 and sets the target secondary-current value I2tgt to 120 mA. When a negative determination is made at step S77 (that is, rising time difference T1<Tb1), the auxiliary-primary-coil control circuit 41 proceeds to step S78 and further determines whether the rising time difference T1 is equal to or greater than the threshold Tb2 (that is, is rising time difference T1≥Tb1?).

When a negative determination is made at step S78 (that is, Tb1≤rising time difference T1<Tb2), the auxiliary-primary-coil control circuit 41 proceeds to step S80 and sets the target secondary-current value I2tgt to 90 mA. When an affirmative determination is made at step S78, the auxiliary-primary-coil control circuit 41 proceeds to step S81 and sets the target secondary-current value I2tgt to 60 mA.

According to the present embodiment, switching of the auxiliary primary coil 21*b* can be determined using the rising time difference T1 between the main ignition signal IGT and the energy supply signal IGW, and the target secondary-current value I2tgt can be set in three stages for each of the cases in which a portion or all of the auxiliary-primary-coil portions 211 and 212 is used.

Here, the switching process in Table 2 and FIG. 26, above, is described using an example in which the circuit is simplified such that the target secondary-current values I2tgt set at processes subsequent to step S73 and step S74 are the same values. However, I2tgt set values based on the determination results at step S75 to step S78 may differ.

Furthermore, as shown as a variation example in FIG. 26, switching of the auxiliary primary coil 21*b* may be determined based on whether the rising of the main ignition signal IGT and the rising of the energy supply signal IGW coincide, that is, presence/absence of a phase shift.

In addition, the energy supply signal IGW can fall and rise again during the on-period of the main ignition signal IGT. In this case, an initial target secondary-current value I2tgt is set based on the presence/absence of a phase shift between the rising of the main ignition signal IGT and an initial rising of the energy supply signal IGW. Furthermore, the target secondary-current value I2tgt can be set again based on a re-rising time Ta until the next energy supply signal IGW rises from the rising of the main ignition signal IGT.

Specifically, as shown in Table 3, below, when an initial phase shift is present, the energy supply operation using all of the auxiliary primary coil 21*b*, that is, both of the auxiliary-primary-coil portions 211 and 212, is performed. At this time, for example, the initial target secondary-current value I2tgt is set to 80 mA. Meanwhile, when the initial phase shift is not present, when the rising time difference T1 is equal to or greater than the time threshold TC, the energy supply operation using a portion of the auxiliary primary coil 21*b*, such as only the auxiliary-primary-coil portion 211, is performed. In addition, for example, the initial target secondary-current value I2tgt is set to 100 mA.

TABLE 3

| IGT and IGW phase shift | Auxiliary primary coil used | 12tgt (Initial set value) | IGW re-rising time from IGT: Less than predetermined value 1 | Predetermined value 1 | Equal to or greater than predetermined value 2 |
|---|---|---|---|---|---|
| Present | All of auxiliary primary coil | 80 mA | 110 mA | 90 mA | 70 mA |
| Absent | Only portion of auxiliary primary coil | 100 mA | 120 mA | 90 mA | 60 mA |

In addition, when the energy supply signal IGW is outputted again before the main ignition signal IGT falls, the re-rising time Ta from the rising of the main ignition switch IGT is calculated. The target secondary-current value I2tgt is set based on this time.

In this case, rather than the target secondary-current value I2tgt being reset based on the initial phase shift, for example, the target secondary-current value I2tgt is respectively reset so as to be divided into three stages: when the re-rising time Ta is short and less than a predetermined lower-limit value (that is, a predetermined value 1 in Table 3); when the re-rising time Ta is long, and equal to or greater than a predetermined upper-limit value (that is, a predetermined value 2 in Table 3); and when the re-rising time Ta is an intermediate time therebetween (that is, between the predetermined value 1 and the predetermined value 2 in Table 3).

For example, as shown in Table 3, when IGW is outputted again after the main ignition signal IGT and the energy supply signal IGW are outputted with a phase difference, the target secondary-current value I2tgt is respectively reset to 110 mA, 90 mA, and 70 mA when the re-rising time of the energy supply signal IGW from the main ignition signal IGT is less than the predetermined value 1, between the predetermined value 1 and the predetermined value 2, and equal to or greater than the predetermined value 2. When the main ignition signal IGT and the energy supply signal IGW are outputted without a phase shift, the initial target secondary-current value I2tgt is respectively reset to 120 mA, 90 mA, and 60 mA.

As a result, switching of the auxiliary primary coil 21*b*, and further, the initial setting of the target secondary-current value I2tgt can be performed by only the presence/absence of the phase shift between the main ignition signal IGT and the energy supply signal IGW. In addition, resetting of the target secondary-current value I2tgt can be performed by the energy supply signal IGW being transmitted again.

Here, the energy supply signal IGW may be repeatedly retransmitted as long as it is before the main ignition signal IGT falls. In addition, a portion of the auxiliary primary coil 21*b* may be used when a phase shift is present between the main ignition signal IGT and the energy supply signal IGW, and all of the auxiliary primary coil 21*b* may be used when a phase shift is not present.

As a result, switching of the auxiliary primary coil 21*b* and, further, the initial setting and setting change of the target secondary-current value I2tgt can be easily controlled using the waveform information of the main ignition signal IGT and the energy supply signal IGW that is transmitted from the engine ECU 100.

Consequently, control can be optimally performed in response to the operation state of the engine in which the energy supply operation following the main ignition operation constantly changes. A compact, high-performance ignition apparatus 10 for an internal combustion engine can be implemented.

The present disclosure is not limited to the above-described embodiments. The present disclosure can be combined with various embodiments of the ignition apparatus for an internal combustion engine, or singly applied. For example, the internal combustion engine can be applied to various spark-ignition-type internal combustion engines, in addition to a gasoline engine for an automobile. In addition, the configurations of the ignition coil 2 and the ignition apparatus 10 can be changed as appropriate based on the internal combustion engine to which the ignition coil 2 and the ignition apparatus 10 are mounted.

For example, according to the above-described embodiments, a configuration in which the auxiliary primary coil 21*b* includes the two auxiliary-primary-coil portions 211 and 212 is described. However, three or more auxiliary-primary-coil portions may be provided. As a result, switching of the auxiliary primary coil 21*b* can be performed based on the power supply voltage and the like, and energy supply can be more reliably performed.

In addition, the ignition coil 2 is merely required to be configured to include the main primary coil 21*a* and the auxiliary primary coil 21*b*. As long as the energy supply circuit unit 4 is configured to be capable of supplying energy to the auxiliary primary coil 21*b*, an energy supply method other than that described according to the above-described embodiments may be used. Similar working effects are achieved.

According to the above-described embodiments, an example in which the energy supply signal IGW is transmitted to each ignition apparatus 10 that is provided in each cylinder is described. However, the present disclosure is not necessarily limited thereto. For example, as described in JP-A-2017-210965, a method in which the energy supply signals IGW for all cylinders are superimposed on a single signal and transmitted to each cylinder may be used. The energy supply signal IGW for an own cylinder may be extracted based on logic with the main ignition signal IGT inside the ignition apparatus 10 and used.

In addition, an example in which the upper-limit threshold and the lower-limit threshold for the target secondary-current value I2tgt of the secondary-current feedback circuit 61 are set inside the secondary-current feedback circuit 61 and used is given. However, the upper-limit threshold and the lower-limit threshold may be set based on the target secondary-current value I2tgt in the target secondary-current-value detection circuit 5 and outputted to the secondary-current feedback circuit 61.

According to the above-described embodiments, when the width of the energy supply signal IGW is within expectations, the configuration is such that the Td delayed one-shot circuit 42 is cleared and prepared for the next operation when the output of the energy supply signal IGW is L level. However, the present disclosure is not necessarily limited thereto. Clearing by the energy supply signal IGW may be eliminated and the circuit may be simplified.

In addition, when the control signal Csel is used, the logic level of the control signal Csel is not limited to a single bit of 0 or 1 and may have multiple bits. Alternatively, the control signal Csel may be outputted and used such that signal voltage levels are divided. As a result, switching of even more auxiliary primary coils 21*b* can be accommodated.

Here, switching of the auxiliary primary coil 21*b* by the control signal Csel may be switched during the energy supply period. As a result, switching of the auxiliary primary coil 21*b* can be performed during discharge, and tracking can be performed at a value that is even more optimal for the combustion state of the engine.

Furthermore, switching based on the rising time difference T1 between the main ignition signal IGT and the energy supply signal IGW may be added to the switching based on the control signal Csel and performed.

According to the above-described embodiments, the switching process for the auxiliary primary coil 21*b* is described with reference to the flowcharts for comprehension. However, the switching process is not limited to a process by software or the like, and may be configured by hardware.

What is claimed is:

1. An ignition apparatus for an internal combustion engine, the ignition apparatus comprising:

an ignition coil in which a main primary coil and an auxiliary primary coil are magnetically coupled with a secondary coil that is connected to a spark plug;

a main ignition circuit configured to control energization of the main primary coil and perform a main ignition operation in which a spark discharge is generated in the spark plug; and an energy supply circuit configured to control energization of the auxiliary primary coil and perform an energy supply operation in which a current that has a same polarity as a secondary current that flows through the secondary coil as a result of the main ignition operation is superimposed on the secondary current, wherein:

the auxiliary primary coil includes a plurality of auxiliary-primary-coil portions;

the energy supply circuit is configured to perform the energy supply operation using one or more of the plurality of auxiliary-primary-coil portions;

the plurality of auxiliary-primary-coil portions are connected to a shared power supply;

the energy supply circuit is configured to control the energy supply operation by switching the connection between the plurality of auxiliary-primary-coil portions and the power supply; and the energy supply circuit is configured to switch the auxiliary-primary-coil portion used in the energy supply operation based on a voltage value of the power supply.

2. An ignition apparatus for an internal combustion engine, the ignition apparatus comprising:

an ignition coil in which a main primary coil and an auxiliary primary coil are magnetically coupled with a secondary coil that is connected to a spark plug;

a main ignition circuit configured to control energization of the main primary coil and perform a main ignition operation in which a spark discharge is generated in the spark plug; and an energy supply circuit configured to control energization of the auxiliary primary coil and perform an energy supply operation in which a current that has a same polarity as a secondary current that flows through the secondary coil as a result of the main ignition operation is superimposed on the secondary current, wherein:

the auxiliary primary coil includes a plurality of auxiliary-primary-coil portions;

the energy supply circuit is configured to perform the energy supply operation using one or more of the plurality of auxiliary-primary-coil portions; and the energy supply circuit is configured to switch the auxiliary-primary-coil portion used in the energy supply operation based on a terminal voltage on an energy-supply side of the auxiliary primary coil or a discharge maintenance voltage of the spark plug.

3. The ignition apparatus for an internal combustion engine according to claim 2, wherein:

the energy supply circuit is configured to estimate the terminal voltage on the energy- supply side of the auxiliary primary coil based on a terminal voltage on a low-voltage side of the main primary coil, and a turn ratio of the main primary coil and the auxiliary primary coil.

4. The ignition apparatus for an internal combustion engine according to claim 3, wherein:

the energy supply circuit is configured to switch the auxiliary-primary-coil portion used in the energy supply operation based on an output signal from a control apparatus of the internal combustion engine.

5. The ignition apparatus for an internal combustion engine according to claim 4, wherein:

the energy supply circuit is configured to switch the auxiliary-primary-coil portion used in the energy supply operation based on waveform information of a main ignition signal that instructs the main ignition circuit to perform the main ignition operation and an energy supply signal that instructs the energy supply circuit to perform the energy supply operation.

6. The ignition apparatus for an internal combustion engine according to claim 5, wherein:

the waveform information is a phase difference between rising of the main ignition signal and rising of the energy supply signal.

7. The ignition apparatus for an internal combustion engine according to claim 6, wherein:

the energy supply circuit is configured to switch the auxiliary-primary-coil portion used in the energy supply operation based on either of a rotation frequency and load of the internal combustion engine, or both.

8. The ignition apparatus for an internal combustion engine according to claim 7, wherein:

the energy supply circuit is configured to switch the auxiliary-primary-coil portion used in the energy supply operation based on a temperature of the ignition coil.

9. The ignition apparatus for an internal combustion engine according to claim 8, wherein:

the energy supply circuit includes a switching element for discharge continuation that opens and closes an energization path to the auxiliary primary coil portion, and a plurality of switching elements that control energization of the plurality of auxiliary primary coil portions during the energy supply operation.

10. The ignition apparatus for an internal combustion engine according to claim 9, wherein:

the energy supply circuit is configured to set a permitted period for the energy supply operation and output a permission signal for the energy supply operation.

11. The ignition apparatus for an internal combustion engine according to claim 10, wherein:

the permission signal is a pulse signal that is generated based on an output signal from a control apparatus of the internal combustion engine, and a maximum period of the permitted period is set based on a pulse width.

12. The ignition apparatus for an internal combustion engine according to claim 1, wherein:

the energy supply circuit is configured to switch the auxiliary-primary-coil portion used in the energy supply operation based on an output signal from a control apparatus of the internal combustion engine.

13. The ignition apparatus for an internal combustion engine according to claim 1, wherein:

the energy supply circuit is configured to switch the auxiliary-primary-coil portion used in the energy supply operation based on either of a rotation frequency and load of the internal combustion engine, or both.

14. The ignition apparatus for an internal combustion engine according to claim 1, wherein:

the energy supply circuit is configured to switch the auxiliary-primary-coil portion used in the energy supply operation based on a temperature of the ignition coil.

15. The ignition apparatus for an internal combustion engine according to claim 1, wherein:

the energy supply circuit includes a switching element for discharge continuation that opens and closes an energization path to the auxiliary primary coil portion, and a plurality of switching elements that control energization of the plurality of auxiliary primary coil portions during the energy supply operation.

16. The ignition apparatus for an internal combustion engine according to claim 1, wherein:

the energy supply circuit is configured to set a permitted period for the energy supply operation and output a permission signal for the energy supply operation.

17. The ignition apparatus for an internal combustion engine according to claim 1, wherein the auxiliary-primary-coil portions are connected in series with an intermediate tap therebetween; and the intermediate tap is grounded via a switching element for switching of the auxiliary primary-coil portions.

18. The ignition apparatus for an internal combustion engine according to claim 2, wherein the auxiliary-primary-coil portions are connected in series with an intermediate tap therebetween; and the intermediate tap is grounded via a switching element for switching of the auxiliary primary-coil portions.

* * * * *